US011578540B2

(12) United States Patent
Slaughter, Jr. et al.

(10) Patent No.: US 11,578,540 B2
(45) Date of Patent: Feb. 14, 2023

(54) DUAL PIPE DRILL HEAD QUICK INTERCHANGE JOINT

(71) Applicant: The Charles Machine Works, Inc., Perry, OK (US)

(72) Inventors: Greg L. Slaughter, Jr., Perry, OK (US); Travis W. Woodson, Orlando, OK (US); Joseph G. Greenlee, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/562,403

(22) Filed: Dec. 27, 2021

(65) Prior Publication Data

US 2022/0120145 A1 Apr. 21, 2022

Related U.S. Application Data

(63) Continuation of application No. 16/532,076, filed on Aug. 5, 2019, now Pat. No. 11,208,851.
(Continued)

(51) Int. Cl.
*E21B 17/043* (2006.01)
*E21B 7/04* (2006.01)
(Continued)

(52) U.S. Cl.
CPC ..... *E21B 17/043* (2013.01); *E21B 7/046* (2013.01); *E21B 17/046* (2013.01);
(Continued)

(58) Field of Classification Search
CPC ..... E21B 17/02; E21B 17/04; E21B 17/046; E21B 17/0465
See application file for complete search history.

(56) References Cited

U.S. PATENT DOCUMENTS 1,204,805 A 11/1916 MacDonald
4,858,703 A 8/1989 Kinnan
(Continued)

FOREIGN PATENT DOCUMENTS

DE 60 2004 002 930 T2 8/2004

OTHER PUBLICATIONS

Ditch Witch, "3.75" TRIHAWK (2-7/8 REG, F / 2.5 SPLN)", parts manual, undated, but were offered for sale in the United States more than one year prior to Aug. 6, 2018, 3 pages, Perry, Oklahoma.
(Continued)

*Primary Examiner* — Tara Schimpf
(74) *Attorney, Agent, or Firm* — Tomlinson McKinstry, P.C.

(57) ABSTRACT

A system for connecting a drill bit and pipe puller to a drill string. The system includes a downhole tool having an internal cavity and a through-hole in its wall. A coupler may be slidingly received in the cavity and connected using one or more fasteners which interconnect a groove in the coupler to the wall of the downhole tool. Fasteners used may be screws or bolts interconnecting the wall of the tool with radial holes in the coupler. Alternatively, bolts may interconnect the wall with a circumferential groove on the coupler. A drill bit may be threaded into the coupler. The coupler allows drill bits and other tools to be connected and disconnected from a downhole tool without unthreading the drill bit.

22 Claims, 22 Drawing Sheets

Related U.S. Application Data

(60) Provisional application No. 62/714,961, filed on Aug. 6, 2018.

(51) Int. Cl.
*E21B 17/046* (2006.01)
*E21B 17/18* (2006.01)
*E21B 10/62* (2006.01)

(52) U.S. Cl.
CPC ..... *E21B 17/0465* (2020.05); *E21B 10/62* (2013.01); *E21B 17/18* (2013.01)

(56) References Cited

U.S. PATENT DOCUMENTS

RE37,975 E 2/2003 Stephenson et al.
RE38,418 E 2/2004 Deken et al.
6,860,514 B2 * 3/2005 Wentworth ..... E21B 17/046 285/333
8,875,811 B1 11/2014 Randa
9,834,995 B2 12/2017 Slaughter, Jr et al.
10,161,199 B2 12/2018 Slaughter, Jr. et al.
2008/0099242 A1 * 5/2008 Tjader ..... E21B 17/0426 175/325.1
2010/0044113 A1 2/2010 Leblanc et al.
2012/0018221 A1 * 1/2012 Crane ..... E21B 10/62 175/57
2012/0267170 A1 * 10/2012 Langenfeld ..... F16L 15/08 175/57
2018/0002990 A1 1/2018 Wilson et al.
2018/0073305 A1 3/2018 Downing
2018/0087330 A1 3/2018 Bradley et al.
2019/0040692 A1 2/2019 Slaughter, Jr.
2019/0277090 A1 9/2019 Slaughter, Jr.

OTHER PUBLICATIONS

German Patent Office, Examiner's Search Report—Office action, dated Jan. 25, 2022, 7 pages.

* cited by examiner

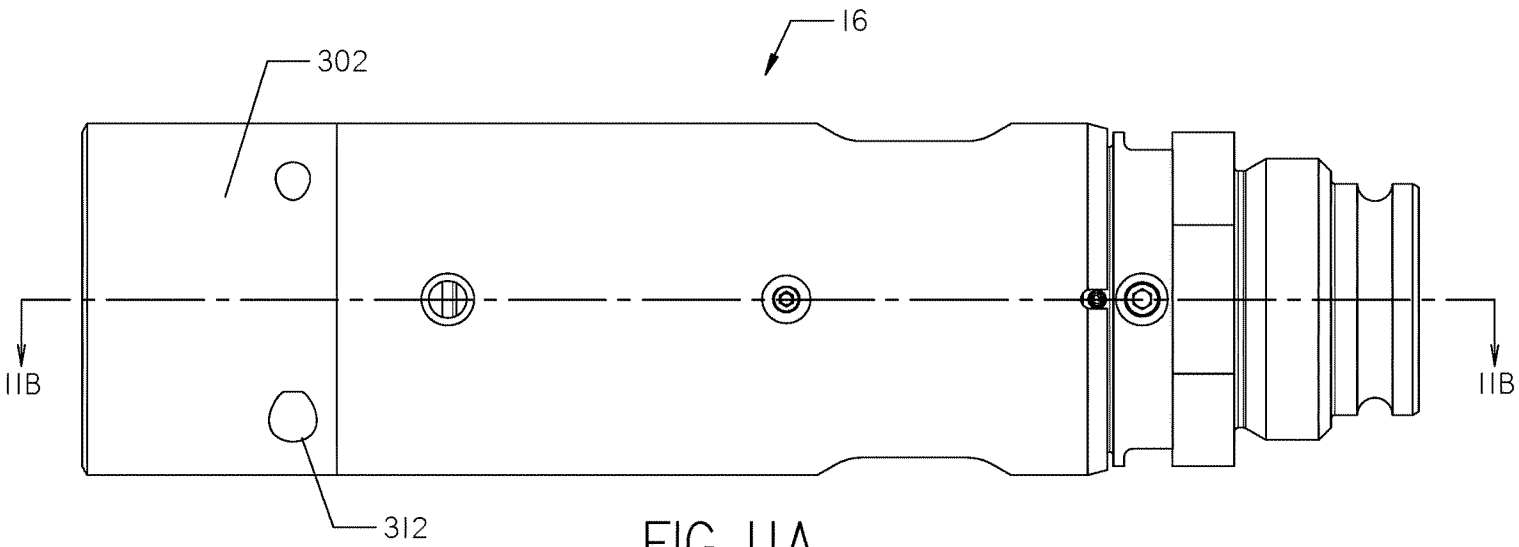
FIG. IIA
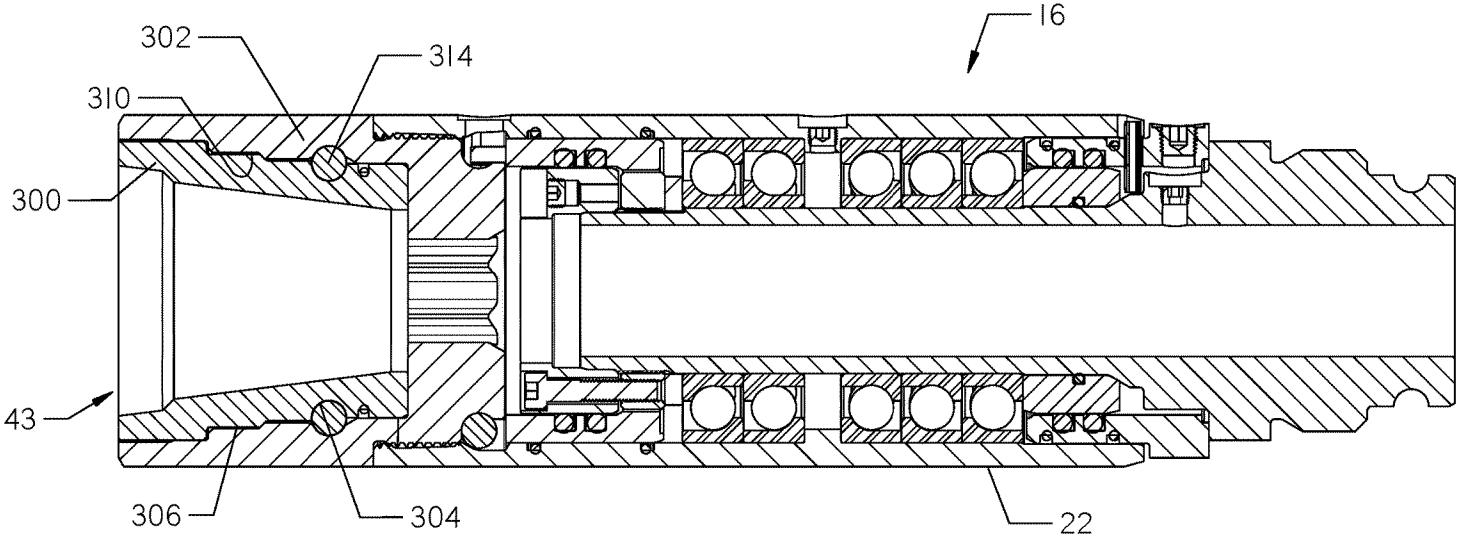
FIG. IIB

DUAL PIPE DRILL HEAD QUICK INTERCHANGE JOINT

BACKGROUND

Often Horizontal Directional Drill (HDD) operations are utilized to drill through rock. These HDD operations require the use of rock drill heads which, in one embodiment, comprise a tricone bit. Tricone drill bits feature three rolling cones. Each cone is situated on a spindle formed on the bit and rotates about the axis of the spindle during drilling.

Cones and corresponding spindles are sized specifically for loads encountered while drilling, particularly in the direction of progression of the pilot bore. In this direction, robust roller bearings or journal bearings support the rotation of the cones about the spindle axis. In order to retain the cones on the spindle, a series of ball bearings or other simple retaining mechanism is incorporated into the design. These retaining features prevent the cones from being pushed off the spindle by incidental reverse loading of the cone as the drill head is removed from the hole.

These retaining mechanisms are typically not properly designed to carry significant loads in a reverse direction. As a result, tricone bits are unsuitable for use as a pulling mechanism when pulling underground utilities directly into a pilot bore.

Many HDD operations in a rock environment support installation of smaller-diameter utility lines. Some of these small lines only require a pilot bore, as a borehole cut in rock will support the pull-back of a small utility line without the need for enlargement by backreaming. There is a need for a method to rapidly disconnect the tricone drill bit and replace the bit with an appropriate mechanism for pulling the utility line into place.

Many bores will open into an exit pit which has been dug into the ground at a target location. The size of the exit pit is wholly dependent on the utility line being installed and the amount of room needed to remove the tricone bit and any associated tooling from the drill string. In addition, replacement of the components with appropriate tooling requires clearance as well.

With smaller utility lines, the product being installed can accommodate smaller exit pit dimensions. However, the removal of the tricone bit itself provides room in the exit pit to accommodate wrench assemblies needed to break out the high torque levels of the connections.

Larger pit sizes require excavation work and manpower, and may have increased shoring requirements. The disruption to the surface of the ground is greater. Often, in the boring operations described herein, the only operations that need to be performed at such a pit are related to replacement of the bit with a pipe puller. Therefore, minimizing the space associated with this task is highly desirable.

The present invention is a device and method to allow for removal of a drill bit from a drill head, and replacement of the drill bit with an appropriate pulling adapter. The invention obviates the need for excess room for the large exit pit that has heretofore been required for such operations, offering savings in both labor and time.

SUMMARY

The present invention is directed to a system. The system has a longitudinal axis. The system comprises an elongate, axially-extending drill string, a connector, and a downhole tool. The drill string is formed from a plurality of pipe sections arranged in end-to-end and torque-transmitting engagement. The drill string has an uphole end and a downhole end. The connector comprises an uphole section, a downhole section, and at least one removable fastener. The uphole section has a torque-receiving relationship with the downhole end of the drill string. The downhole section is formed as a separate piece from the uphole section. The removable fastener extends in a non-axial direction and joins the downhole and uphole sections in torque transmitting engagement. The downhole tool is disposed in torque-receiving engagement with the downhole section of the connector.

The present invention is also directed to a fastening system. The fastening system comprises a drill head, a component having an end section, and at least one fastener. The drill head has an open-ended terminal section that surrounds a hollow cavity, the terminal section having a through-hole defined in its exterior surface such that the through-hole communicates with the cavity. The end section of the component is slidingly receivable in the cavity. The end section is characterized by at least one depression formed in its exterior surface. The fastener is configured to interconnect the through-hole of the drill head and the depression of the component. The component is a selected one of a drill bit or a hollow body having a threaded inner surface.

In another embodiment, the invention is directed to a kit. The kit comprises an elongate hollow body, at least one fastener, and a drill bit. The body is defined by a threaded internal surface and at least one externally-disposed depression. The fastener is registrable to the at least one externally-disposed depression. The drill bit comprises a cutter and a threaded external surface corresponding to the threaded internal surface of the body.

BRIEF DESCRIPTION OF THE DRAWINGS

FIG. 11A is a front elevation view of a drill head with an alternative coupler installed at the left end.

FIG. 11B is a front cross-sectional view of the drill head and coupler of FIG. 11A, taken along line 11B-11B.

DETAILED DESCRIPTION

Figure 1:
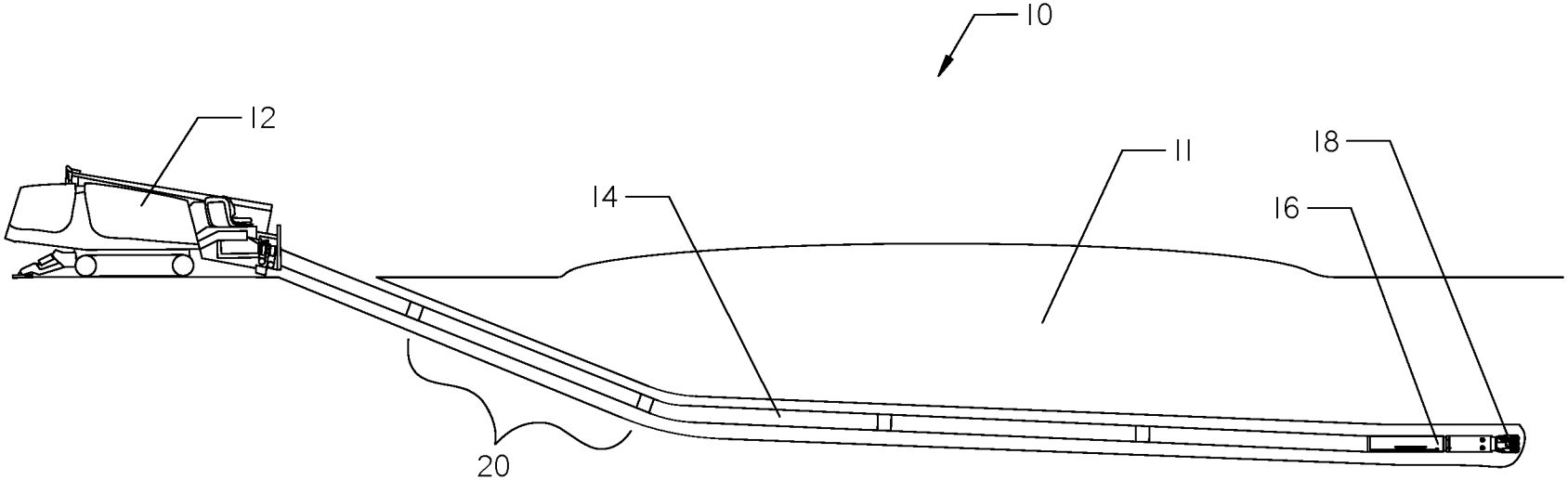
FIG. 1 is a diagrammatic representation of a horizontal directional drilling (HDD) operation.

With reference to FIG. 1, a horizontal directional drilling system 10 for creating a borehole in an underground environment 11 is shown. The drilling system 10 comprises a drilling machine 12, a drill string 14, and a drill head 16 supporting a drill bit 18. The drilling machine 12 rotates and thrusts the drill string 14, so that rotation and thrust are transferred to the drill bit 18, allowing it to advance through the underground environment 11. The drill string 14 is made up of a plurality of pipe segments 20 which are added as the drill bit 18 advances.

Drill bits 18 may be connected to the drill string 14 by threading a threaded male connection end to a matching set of lands which are integrally formed in the drill head 16. When the borepath reaches a terminal end at the surface of the ground or an exit pit, a pipe puller (FIGS. 7A-7C) is attached.

The pipe segments 20 may have an inner and outer component, each independently rotatable. Such dual-member drill strings 14 are utilized to steer a roller cone or other drill bit 18. The drill head 16, which is rotated by the joined outer members of the dual-member drill string 14, is characterized by a bend that allows the drill string 14 to be steered. The inner member rotates the drill bit 18 to dislodge material from the underground environment 11. One such dual-member drill string is disclosed in U.S. Pat. No. RE38,418, issued to Deken, et. al., the contents of which are incorporated herein by reference.

Figure 2:
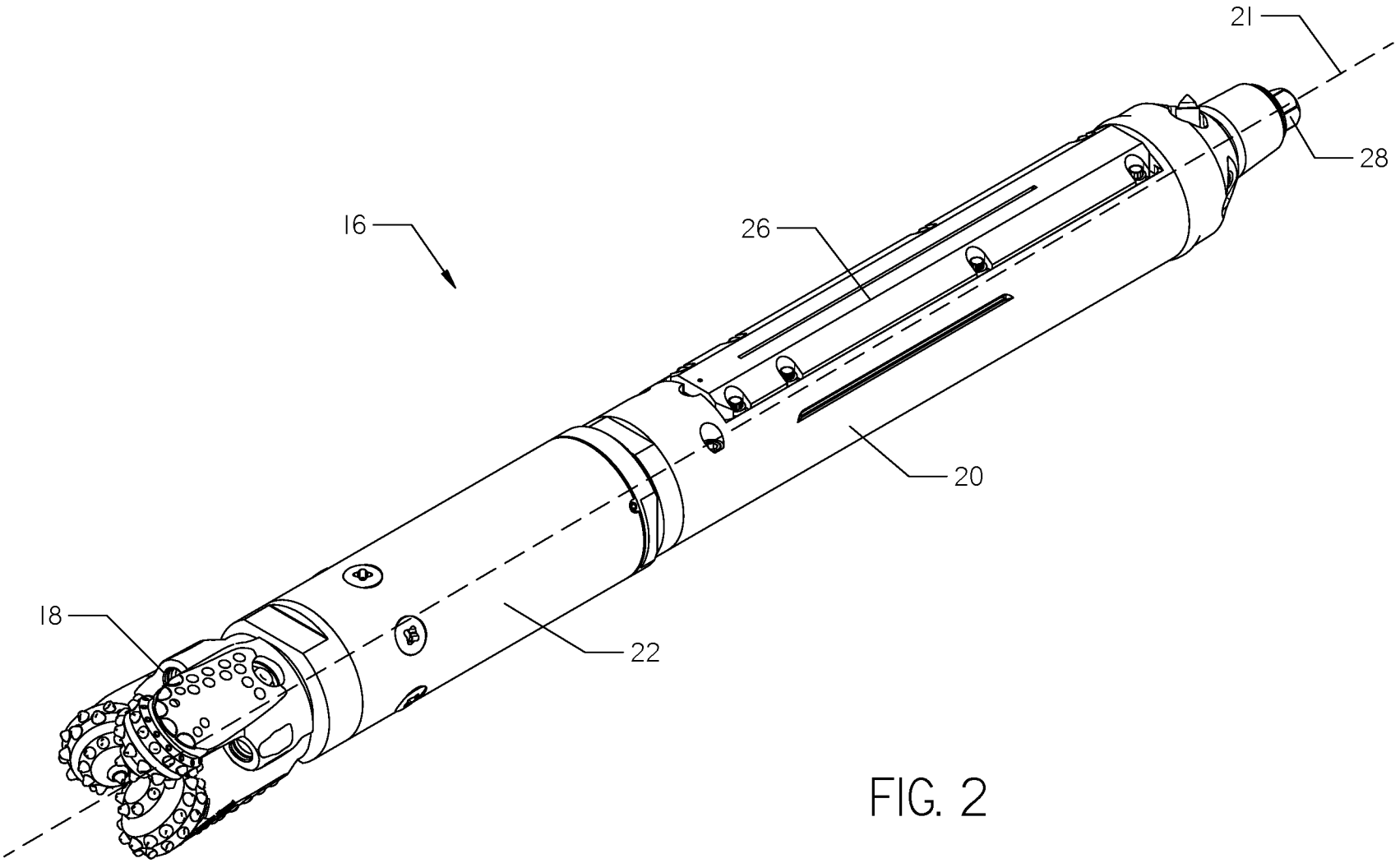
FIG. 2 is a perspective view of a drill head that has been joined to a drill bit by a coupler.
Figure 3A:
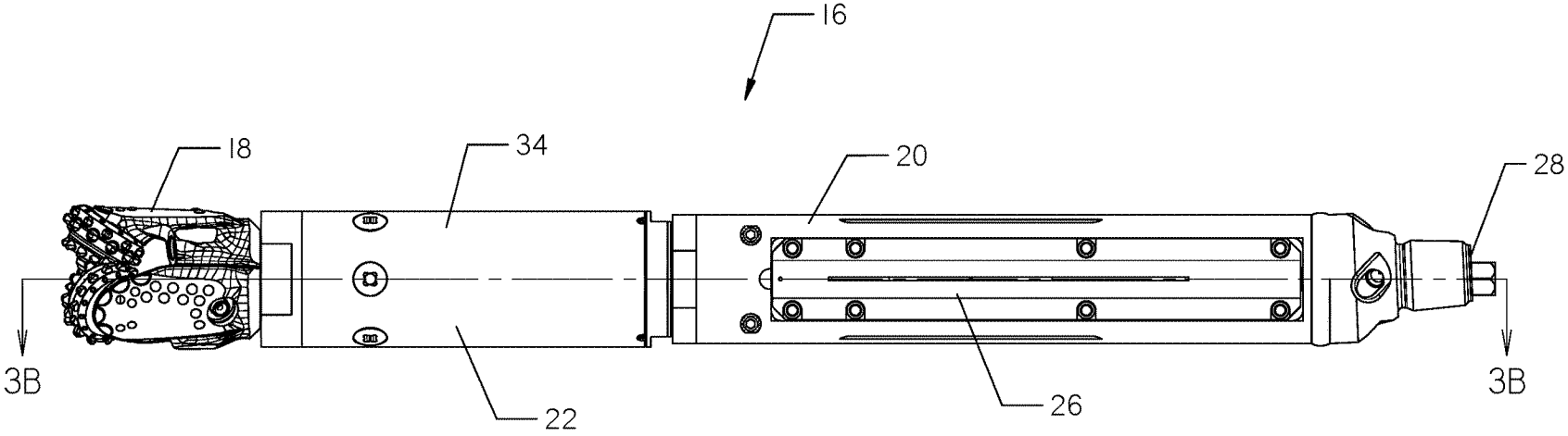
FIG. 3A is a front elevation view of the drill head of FIG. 2, with the drill bit attached to the drill head by a coupler.
Figure 3B:
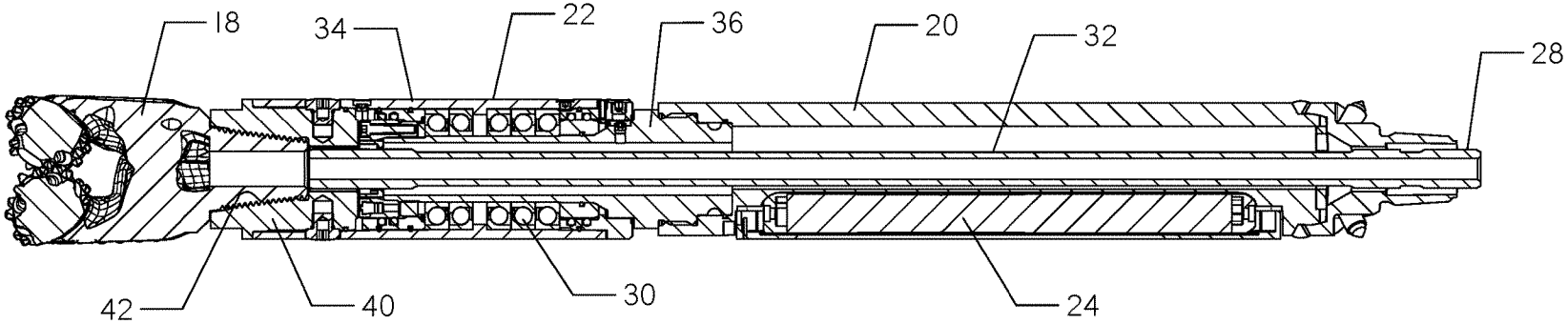
FIG. 3B is a front cross-sectional view of the drill head, coupler and drill bit shown in FIG. 3A, taken along line 3B-3B.
Figure 4A:
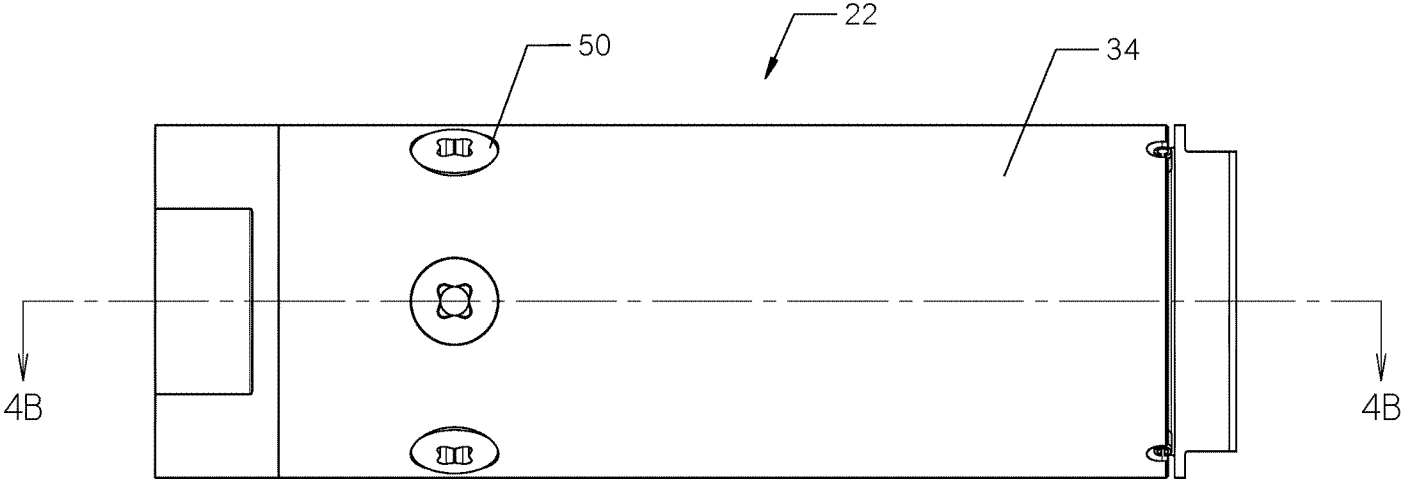
FIG. 4A is an enlarged front elevation view of the coupler shown in FIG. 2, together with the bearing assembly of the drill head. The drill bit has been removed.
Figure 4B:
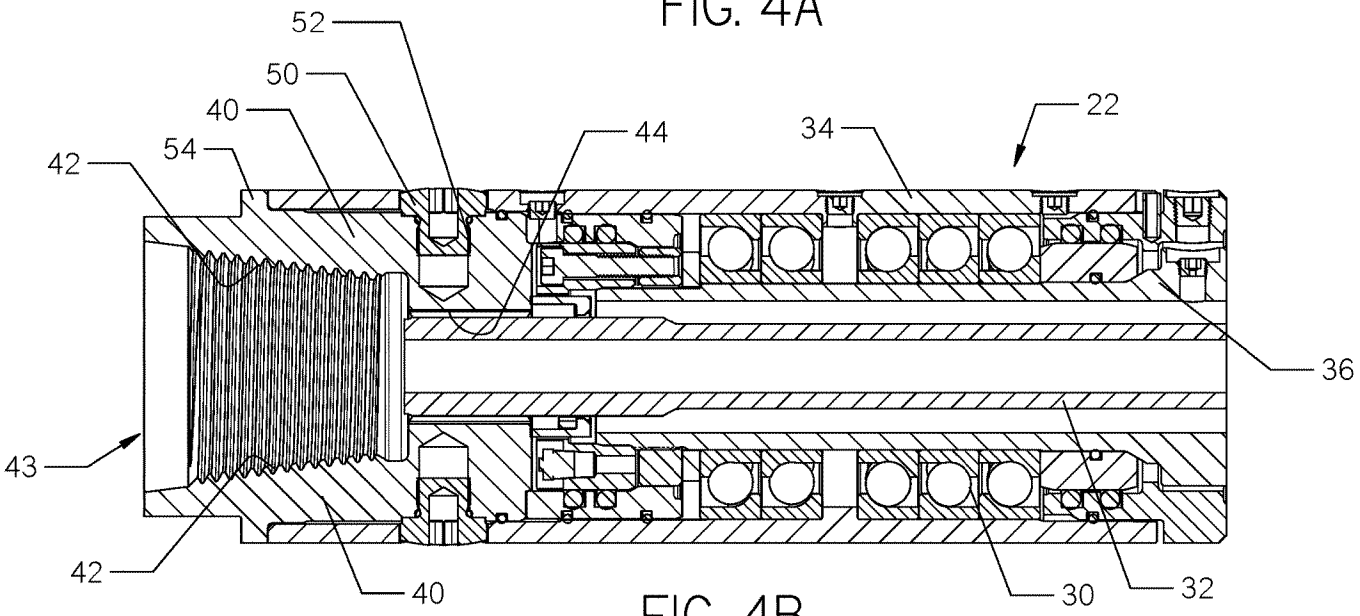
FIG. 4B is a front cross-sectional view of the drill head and coupler shown in FIG. 4A, taken along line 4B-4B.

Drill bits 18 used in horizontal directional drilling operations may comprise tricone bits, as shown in FIGS. 2-3B. Tricone bits include three rotating cones. Carbide buttons are mounted externally on the walls of each cone. As the cones rotate, the buttons cut away material, thereby forming a borehole. Other drill bits 18 such as diamond bits, PDC bits, slanted bits, and the like may be utilized. All drill bits 18 have one or more cutters that interact with the underground environment to dislodge material.

With reference to FIGS. 2-5, a drill head 16 is shown. In FIGS. 2-3B, the drill head 16 is attached to the drill bit 18. The drill head comprises a beacon housing 20 and a bearing assembly 22. The beacon housing 20 is shown with a beacon 24 disposed therein. The beacon 24 may be removed and serviced by removing a door 26 from the side of the beacon housing. A connection point 28, uphole on the drill head 16, is connected to a downhole end of a dual-member drill string 14 (FIG. 1). The drill head 16 acts as a connector between the drill string and the drill bit 18.

With reference to FIGS. 3A-4B, the bearing assembly 22 comprises a plurality of bearings 30 which allow relative rotation between the inner and outer members of the drill string 14. An internally disposed shaft 32 is coupled to the inner member of the drill string 14, while the outer wall of the beacon assembly 20 is coupled to the outer member.

The shaft 32 transfers rotation to the drill bit 18. An outer wall 34 of the bearing assembly 22 is mechanically coupled to the drill bit 18. The outer wall of the beacon assembly 20 is mechanically coupled to an inner wall 36 of the bearing assembly 22. The bearings 30 allow for the transfer of thrust force from the inner wall 36 to the drill bit 18 while allowing rotation of the shaft 32 remain independent from any rotation of the inner wall 36 or the beacon housing 20.

The drill bit 18, drill head 16 and drill string 14, when assembled, extend generally along a longitudinal axis. It should be understood that references to items being "radially disposed" are intended to specifically reference the longitudinal axis of this assembly. Likewise, references to "axial" or "longitudinal" directions are given with reference to the longitudinal axis of the system, which is designated with reference numeral 21 in FIG. 2.

The drill head 16 differs from previous downhole tools in that it does not have an integral threaded connection point for connecting to the drill bit 18. Rather, the drill head has a cavity 39 formed by the outer wall 34 of the bearing assembly 22. The cavity 39 is configured to slidingly receive a coupling 40. The coupling 40 provides a torque-transmitting and thrust-transmitting connection between the bearing assembly 22 and the drill bit 18. The coupling 40 thus forms a downhole section of the connector between the drill bit 18 and the dual-member drill string 14.

In FIGS. 3A-3B, the cavity 39 is integrally formed on the drill head 16. In the alternative embodiments shown in FIGS. 8A-8E and 10A-10C, a receiving coupler 150, 250 is attached to the drill head 16.

As shown in FIGS. 4A-5B, the coupling 40 has opposed first 43 and second 44 openings. The first opening 43 is configured to receive a threaded drill bit 18, as shown in FIG. 3B. The coupling 40 has internally-disposed lands 42 for a threaded connection to the male connection end of the drill bit 18, though splines or other connections may be utilized. The second opening 44 is configured to receive the shaft 32. As shown best in FIG. 4B, the shaft 32 extends into the second opening 44 when the coupling 40 is fully disposed within the cavity 39 of the drill head 16.

Figure 5B:
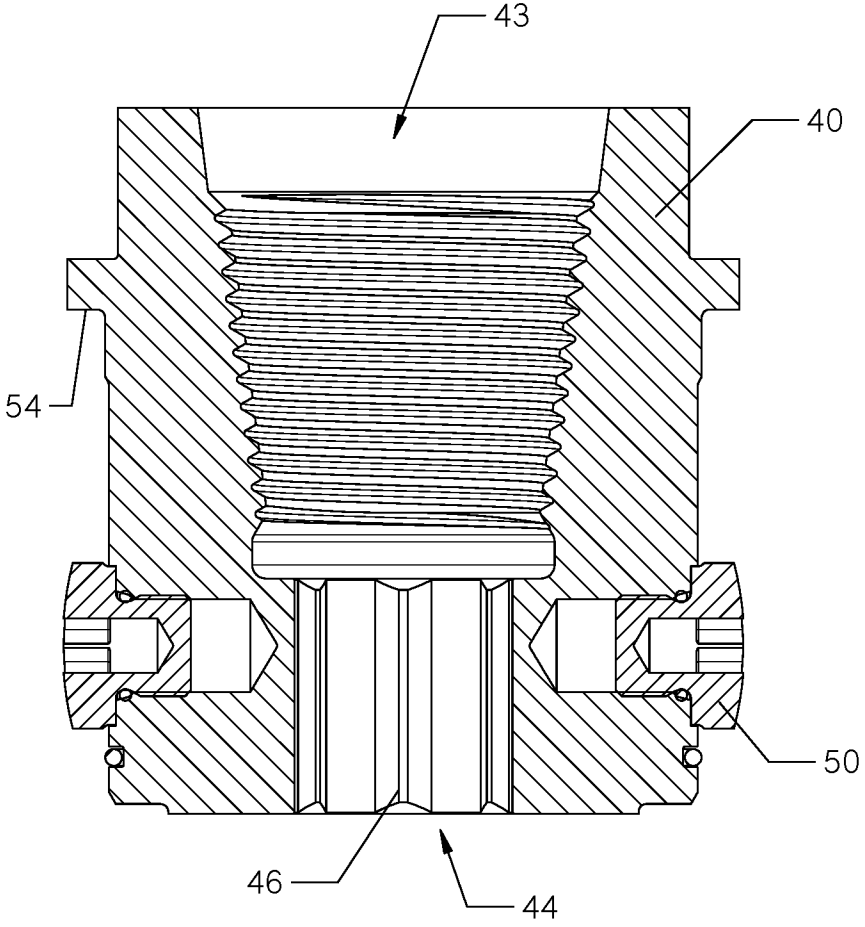
FIG. 5B is a front cross-sectional view of the coupler shown in FIG. 5A, taken along line 5B-5B.
Figure 5A:
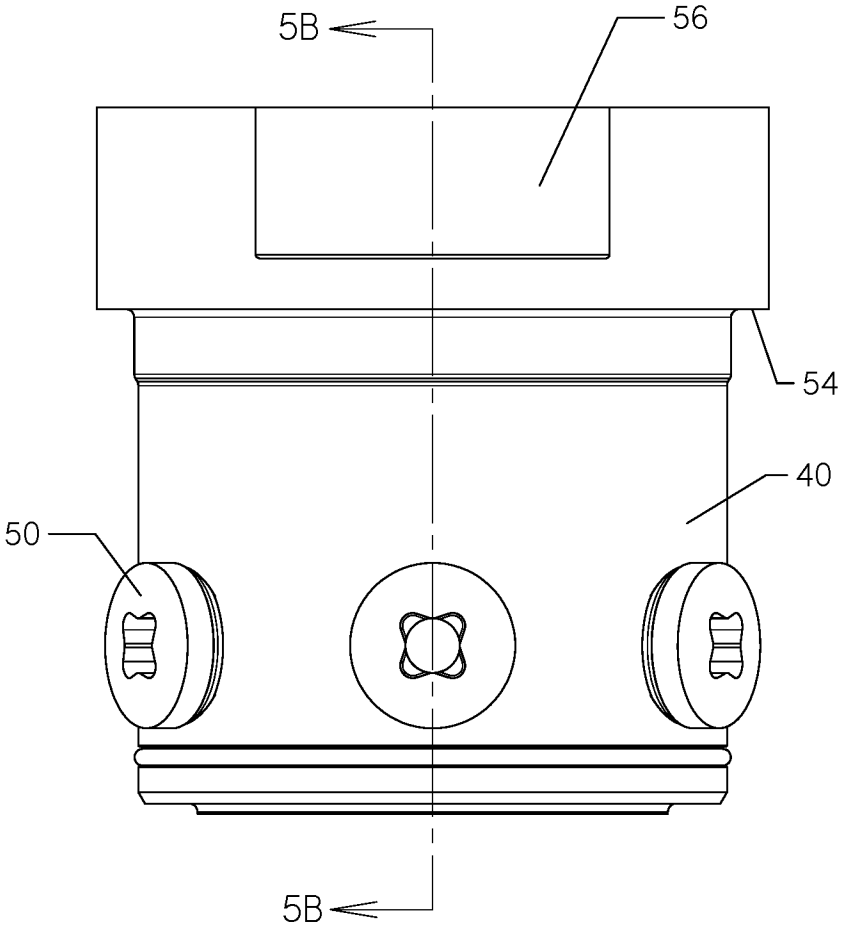
FIG. 5A is an enlarged front elevation view of the coupler shown in FIGS. 3A-4B. Bolts are installed on the coupler body.
Figure 5C:
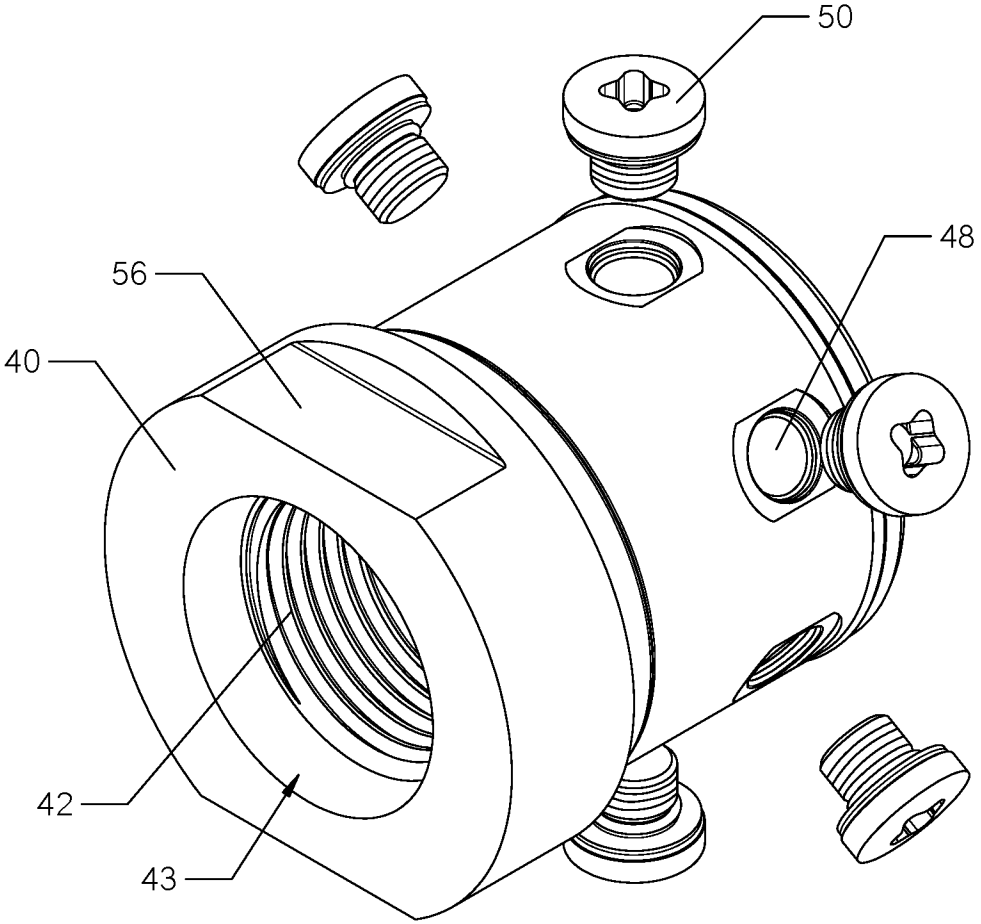
FIG. 5C is an exploded perspective view of the coupler of FIGS. 5A-5B.
Figure 5D:
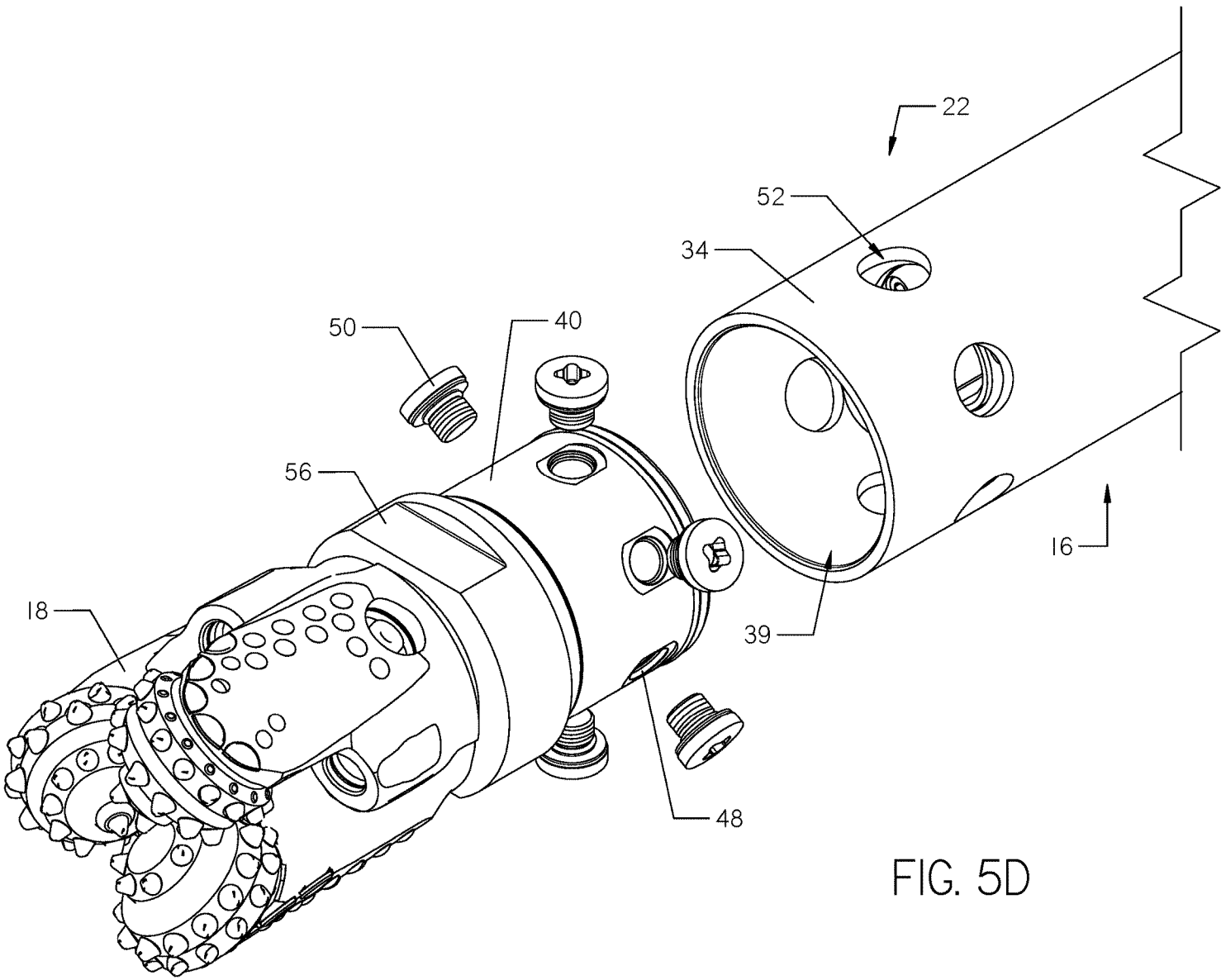
FIG. 5D is an exploded perspective view of the coupler of FIGS. 5A-5C, attached to a drill bit, with the cavity of the drill head shown.
Figure 5E:
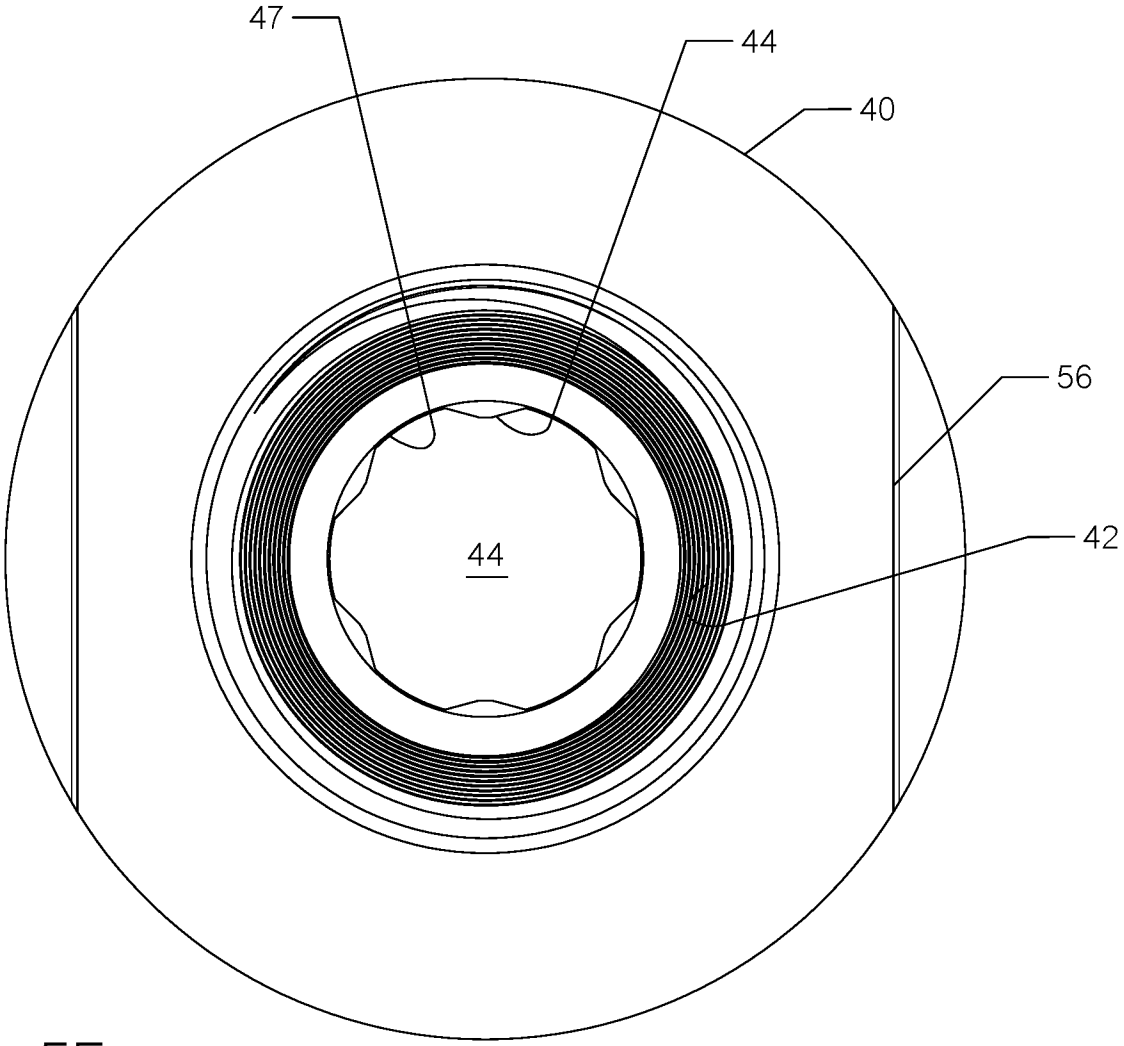
FIG. 5E is an end view of the coupler of FIGS. 5A-5D with protrusions visible at the back opening thereof.

The shaft 32 is preferably shaped with flats such that rotation may be transferred to a complementary projecting feature or features 46 (FIG. 5E) on the second opening 44. In the embodiments of FIGS. 2-5E, the shaft 32 is a hexagonal prism while the second opening 44 is complementary to a cylinder, but interrupted with flat features which reduce the effective diameter of the opening. As best shown in FIG. 5E the features 46 are ridges disposed on the interior-facing wall 47. The ridges 46 interrupt the rotation of the shaft 32, causing the shaft 32 to rotate the coupler 40 and an attached drill bit 18 (FIG. 5D).

In this way, the second opening 44 is engaged by flat sides of the hexagonal shaft 32. This orientation leaves a space between the wall of the opening 44 and the shaft 32 so that drilling fluid may be conveyed from the drill string 14, through the drill head 16, and into the drill bit 18, which may comprise one or more fluid ports near its cutting surface.

With reference to FIGS. 5A-5D, the coupler 40 has a plurality of radially-distributed depressions or cavities 48 on its exterior surface. As shown, coupler 40 has six cavities 48, each offset by approximately sixty degrees about the outer surface of the coupler 40. A corresponding number of bolts 50 are configured to pair with the cavities.

With reference again to FIGS. 4A-4B, the outer wall 34 of the bearing assembly 22 has a plurality of radial openings 52 corresponding to the radial cavities 48 of the coupler 40. The bolts 50 may be placed through the openings 52 into the cavities 48 and secured, either by threads or other means. The bolts 50 rotationally pair the coupler 40 to the outer wall 34. Further, thrust imparted through the bearing assembly 22 may be applied to the coupler (and thus the drill bit 18) through the bolts 50. Additionally, the coupler 40 may have a shoulder 54 against which the outer wall 34 abuts, allowing for transfer of thrust from the outer wall 34 to the drill bit 18.

The coupler 40 may have one or more flats 56 disposed on its exterior. The flats 56 provide a location for a tool to grip the coupler 40 when connecting and disconnecting the drill bit to and from the coupler 40.

The drill bit 18 thus may be threaded to the coupler 40 while disconnected from the drill string 14 or drill head 16. Once connected, the coupler may be placed into the cavity 39 such that the shaft 32 is within the second opening 44 and the cavities 48 aligned with openings 52. Bolts 50 then secure the coupler 40 to the drill head 16, and the drill string is ready for operation.

Once a borehole is drilled to an exit point, the drill bit 18 may be removed by removing the bolts 50 and sliding the coupler 40 out of the cavity 39. Separation of the drill bit 18 and coupler 40 may take place separately from the remaining drilling and pipe installation operations.

Figure 6:
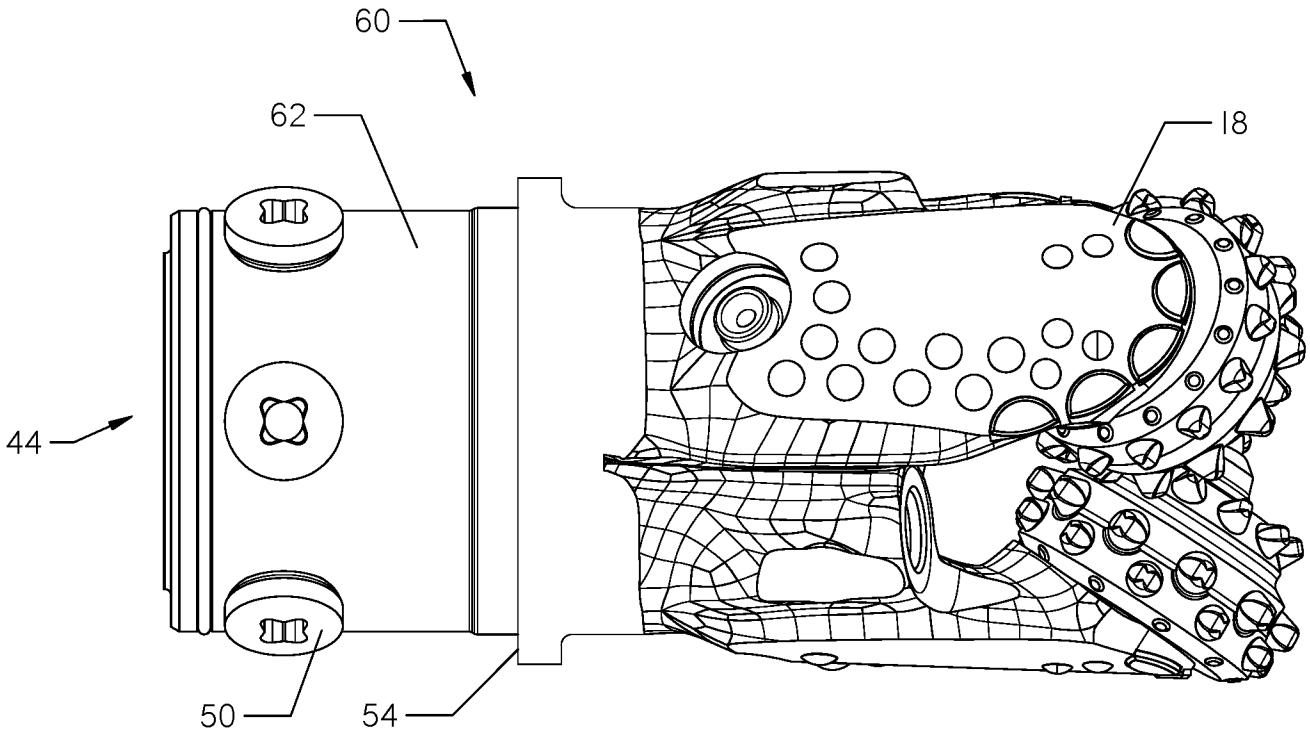
FIG. 6 is a front elevation view of a drill bit having a stub end that includes features similar to the coupler shown in FIGS. 4A-5E.

While FIGS. 2-5E show a coupler 40 that is separate from the drill bit 18, a dedicated drill bit 60, as shown in FIG. 6, may be manufactured with an integral tricone bit 18 and a stub end 62 that fits within the cavity 39. The stub end 62 and has radial cavities 48 within which bolts 50 attach for connection to the drill head 16. A shoulder 54 abuts the outer wall 34 (FIG. 4A-4B) of the drill head 16. An opening 44 couples the dedicated drill bit 60 to the shaft 32. Therefore, while the coupler 40 is provided in the figures for connection to a conventional drill bit 18, the coupler 40 and drill bit 18 may be made integral for use with the drill head 16.

Figure 7A:
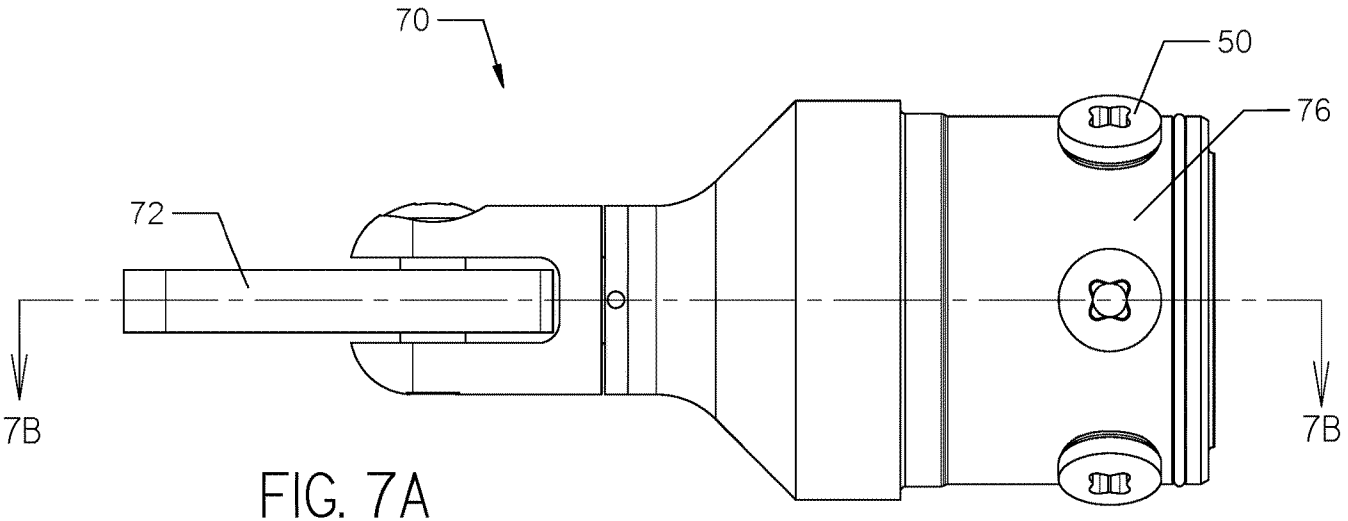
FIG. 7A is a front elevation view of a pipe puller with a stub end with similar external features to the coupler of FIGS. 4A-5E.
Figure 7B:
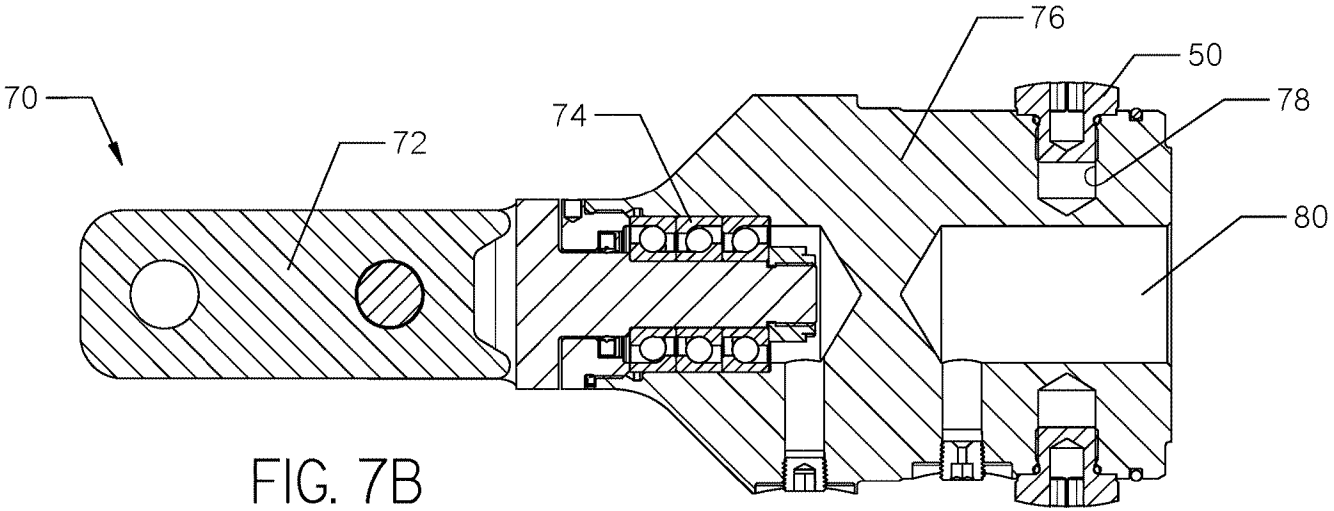
FIG. 7B is a sectional view of the pipe puller of FIG. 7A taken along line 7B-7B.
Figure 7C:
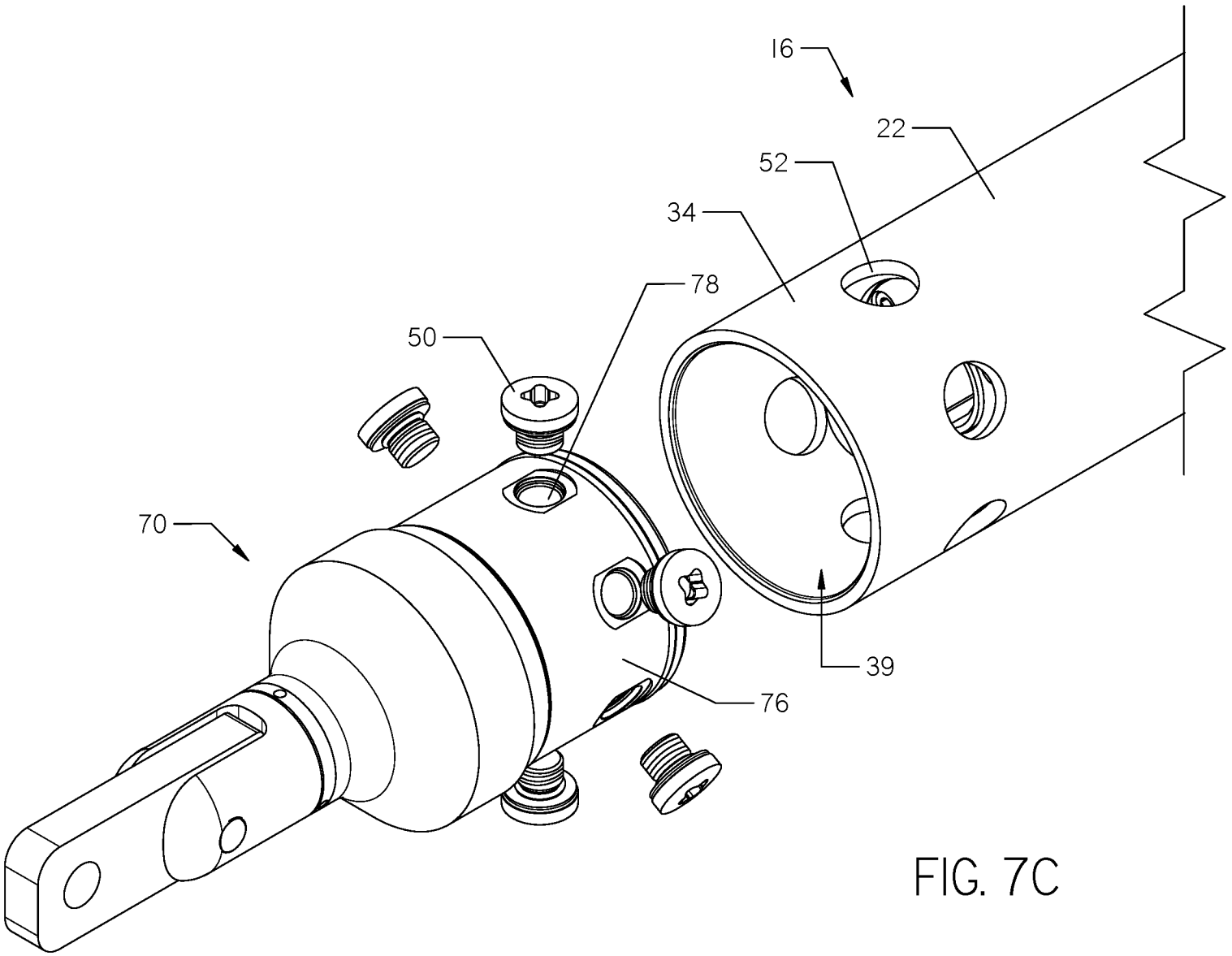
FIG. 7C is an exploded perspective view of the pipe puller of FIGS. 7A-7B, with the cavity of the drill head shown.

With reference to FIG. 7A-7C, a pipe puller 70 is shown. The pipe puller comprises a shackle 72, a bearing assembly 74 and a stub end 76. The shackle 72 facilitates connection to a product pipe (not shown) to be pulled back through the borehole by retraction of drill string 14 (FIG. 1). The bearing assembly 74 comprises a plurality of bearings, and allows the stub end 76 to rotate independently of the shackle 72. This isolates the shackle 72 from any rotation of the drill string 14, preventing injury to the pipe being installed due to wind-up or twisting.

The stub end 76 is configured for insertion into the cavity 39 of drill head 16. The stub end 76 has a plurality of cavities 78 which are situated radially about the periphery of the stub end 76 for connection to bolts 50 through openings 52 in the drill head. As shown, the same bolts 50 may be used to connect the coupler 40 at cavities 48 and the pipe puller 70 at cavities 78.

The stub end 76 has an internal opening 80 for placement of the shaft 32. The internal opening 80 may have a uniform, featureless inwardly facing surface such that the shaft may freely rotate relative to the stub end 76 during pullback operations.

With reference to FIGS. 8A-8E, an alternative coupler 140 is shown. The coupler 140, like coupler 40, has a first opening 43 with lands 42 corresponding to threads on an associated drill bit 18. The coupler 140 comprises a circumferential groove 142 disposed about the stub end 144 of the coupler 140.

Figure 8A:
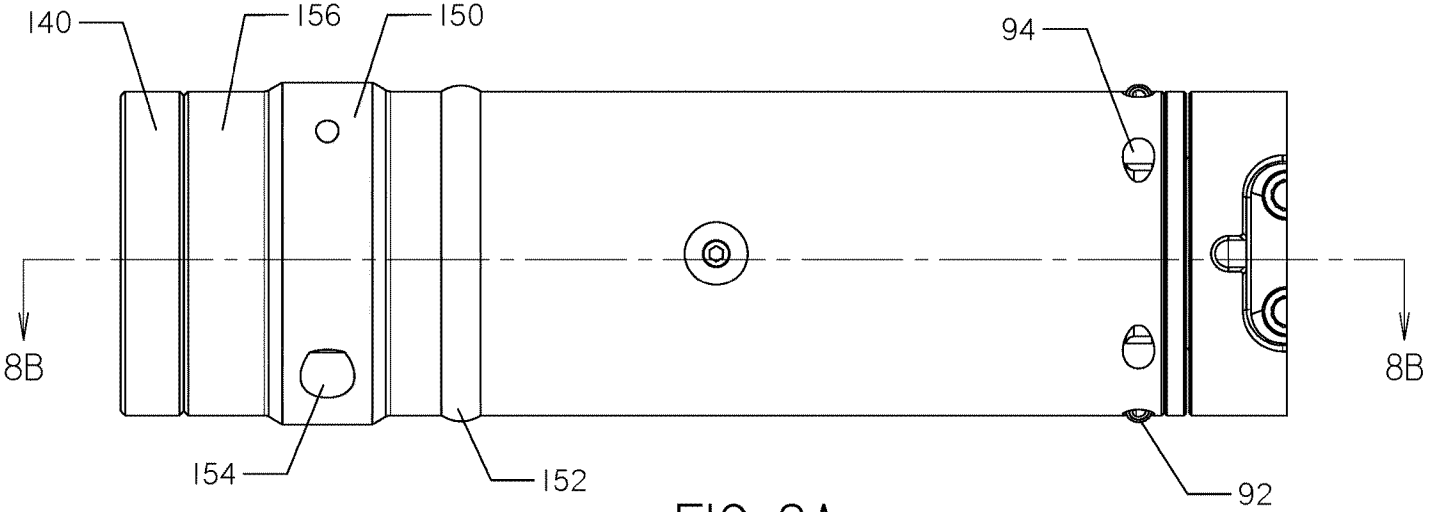
FIG. 8A is a front elevation view of a drill head with an alternative coupler installed at the left end.
Figure 8B:
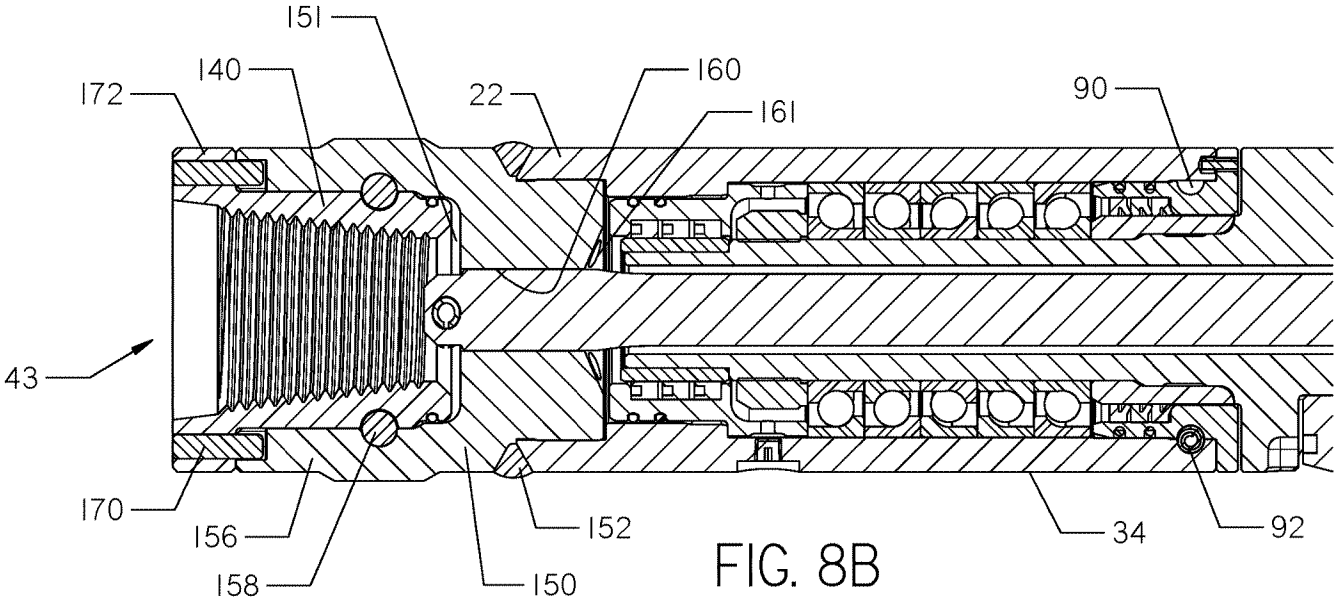
FIG. 8B is a front cross-sectional view of the drill head and coupler of FIG. 8A, taken along line 8B-8B.
Figure 8C:
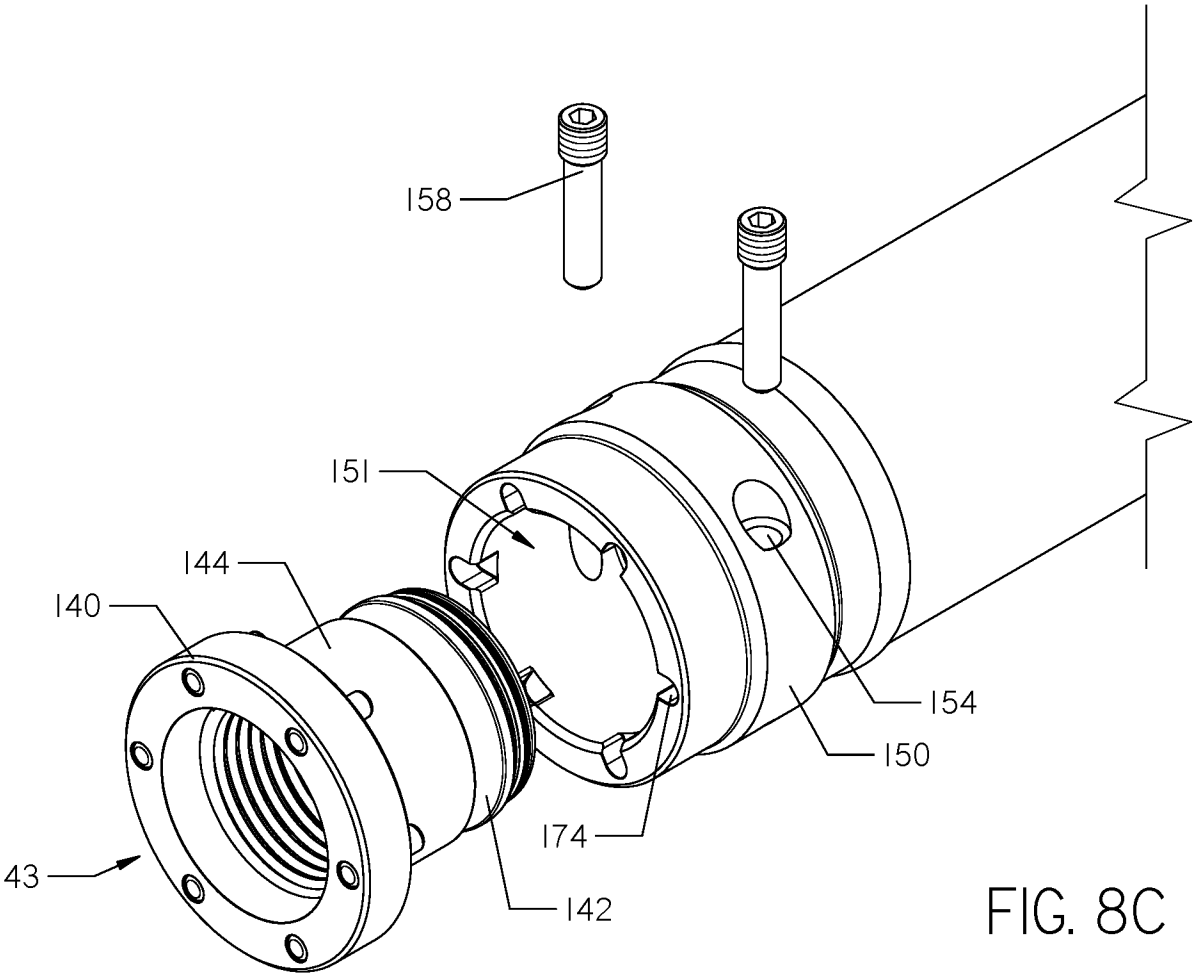
FIG. 8C is an exploded perspective view of the alternative coupler of FIG. 8A-8B, with a cavity of a receiving coupler shown.
Figure 8D:
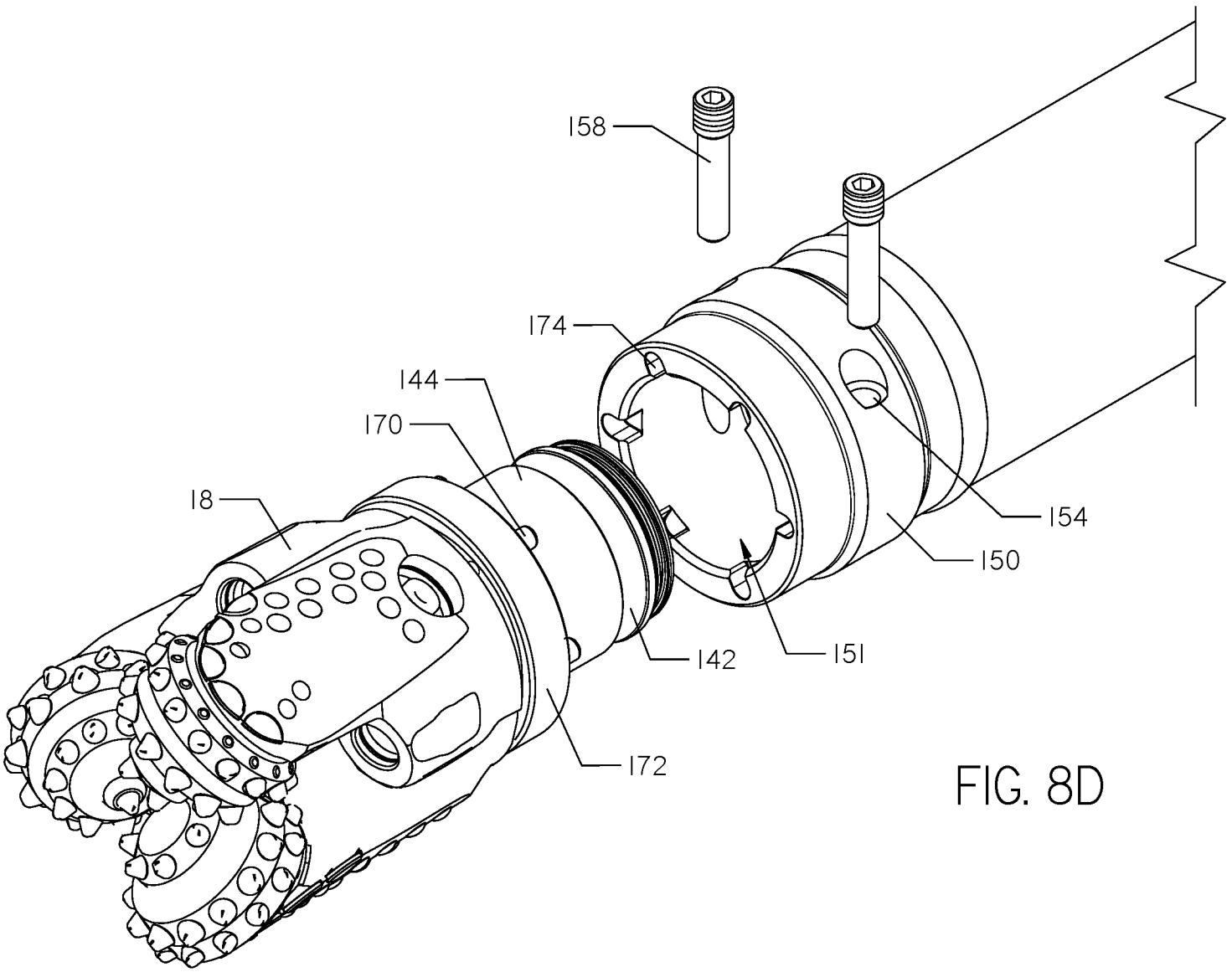
FIG. 8D shows the coupler of FIG. 8C after assembly of a drill bit. Also shown is a portion of the receiving coupler of the drill head, prior to assembly with the drill bit and coupler.

As best shown in FIG. 8B, the bearing assembly 22 is attached to a receiving coupler 150. The receiving coupler 150 has an internal cavity 151 for receiving the coupler 140. The receiving coupler 150 has sets of through-holes 154 disposed in its outer wall 156 corresponding to the circumferential groove 142 when the stub end 144 is disposed within the cavity 151, as in FIG. 8B. Each set of through-holes 154 are configured to receive a bolt or pin 158. As shown, two bolts 158 are used to connect receiving coupler 150 to coupler 140. The bolts 158 are substantially disposed at a tangent to the circumferential groove. The bolts 158 have threads to attach to lands at the opposite through-hole. The engagement of each side of the through-hole 154 holds the pin in place, while the depth of the groove 142 engages the bolt 158 and prevents axial movement. Alternatively, a roll pin may be used to engage the groove 142.

As shown, the receiving coupler 150 is attached to the outer wall 34 of the bearing assembly 22 by a weld 152, though other connections are contemplated. In the embodiment of FIGS. 8A-8E, the receiving coupler 150 rotates with the outer wall 34. Alternatively, the receiving coupler could be made integral with the outer wall 34.

Figure 8E:
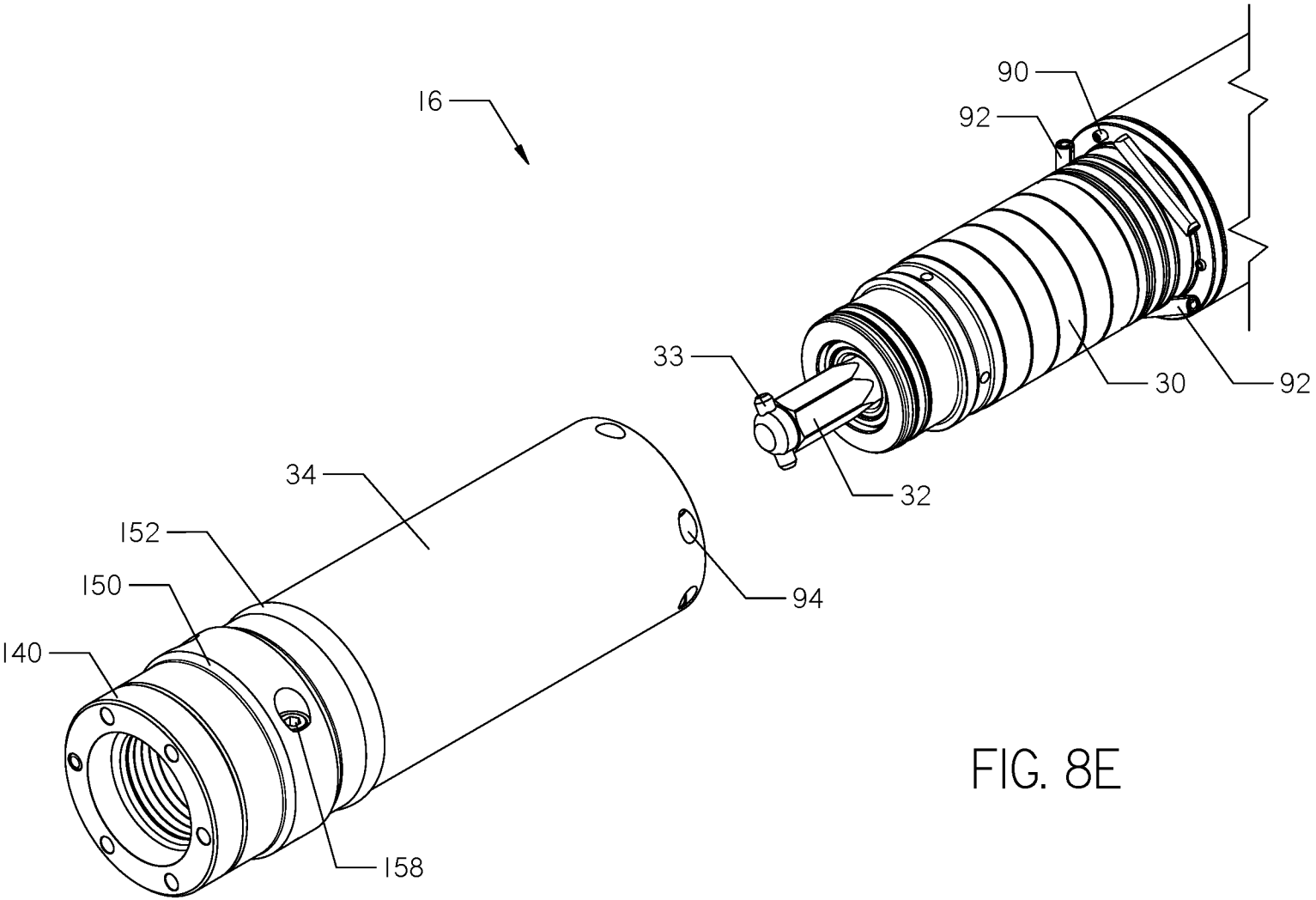
FIG. 8E is a perspective view of the assembled coupler and the bearing assembly of the drill head shown in FIG. 8A. The bearing assembly is shown in exploded form.
Figure 8F:
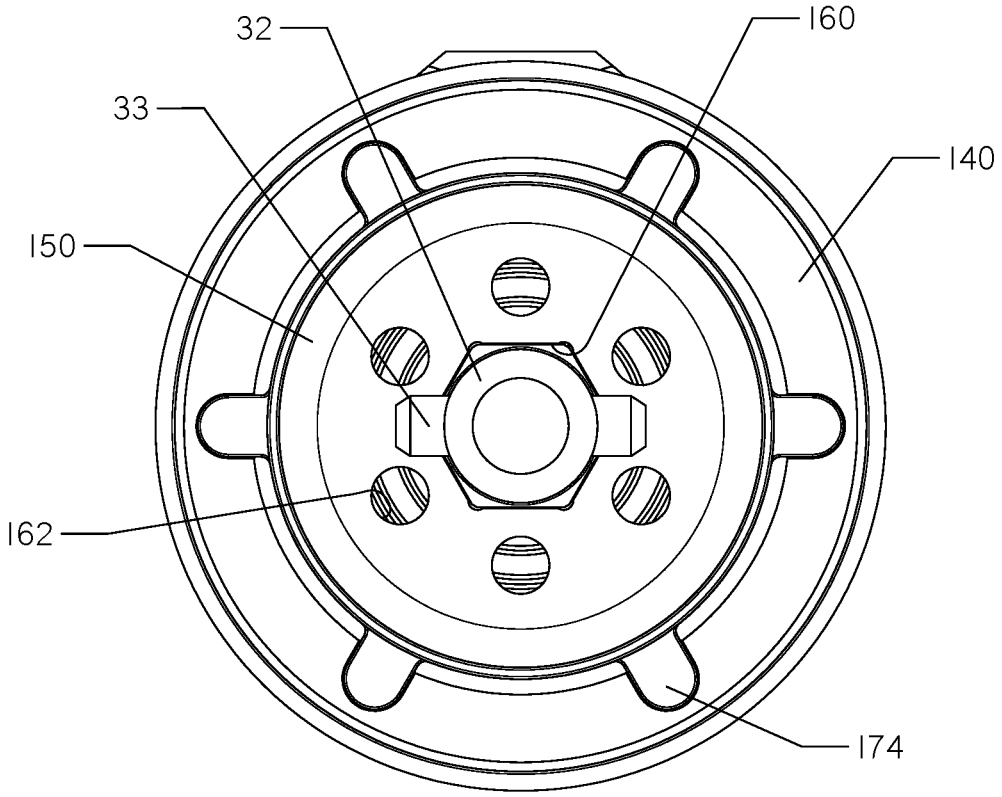
FIG. 8F is an end view of the receiving coupler of FIG. 8C.

With reference to FIG. 8F, the shaft 32 transfers rotational force to the receiving coupler 150 through engagement between the hexagonal shaft and the complementary inner wall 160. Fluid flow is provided through one or more flow holes 162 extending through the receiving coupler 150 and terminating at the cavity 151.

The coupler 140 further comprises a plurality of dowel rods 170. The dowel rods 170 are disposed in a flange 172 and correspond to recesses 174 located in the outer wall 156 of the receiving coupler 150. Dowels rotationally lock the coupler 140 to receiving coupler 150. Placement of the bolts 158 within the holes 154 and circumferential groove 142 likewise axially lock the coupler 140 and receiving coupler 150. The drill bit 18 may be threaded into the first opening 43 of coupler 140. Torque transmitted by the shaft 32 is applied through the inner surface 160 to the receiving coupler 150, then through dowel rods 170 to the coupler 140. Rotation is transmitted to the drill bit 18 through its threaded connection with the coupler 140.

With reference to FIGS. 8B and 8E-8F, the shaft 32 may come equipped with a pin 33. The pin 33 may be retractable, or may be placed in the shaft after the shaft enters the cavity 151 of the receiving coupler 150. The pin 33 locates the shaft within the cavity 151 and prevents it from disengaging.

With reference to FIGS. 8B and 8E, the outer wall 34 must affix the receiving coupler 150 through weld 152 to the bearing assembly 30. A circumferential groove 90 is formed in the bearing assembly 30. One or more roll pins 92 are configured to be received in through-holes 94 disposed in the outer wall 34. When the pins 92 are fully disposed in the through-holes 94, they engage the depth of the groove 90 to prevent relative axial movement between the outer wall 34 and bearing assembly 30.

The receiving coupler 150 is held in axial relationship to other sections of the drill head 16 through the roll pins 92. The outer section of the bearing assembly 30, the receiving coupler 150, the outer wall 34 and the roll pins 92 all rotate with the shaft 32 and the inner member of the dual-member drill string 14. Alternatively, bolts or other fasteners may be used to secure the outer wall 34 to the bearing assembly 30.

Figure 9B:
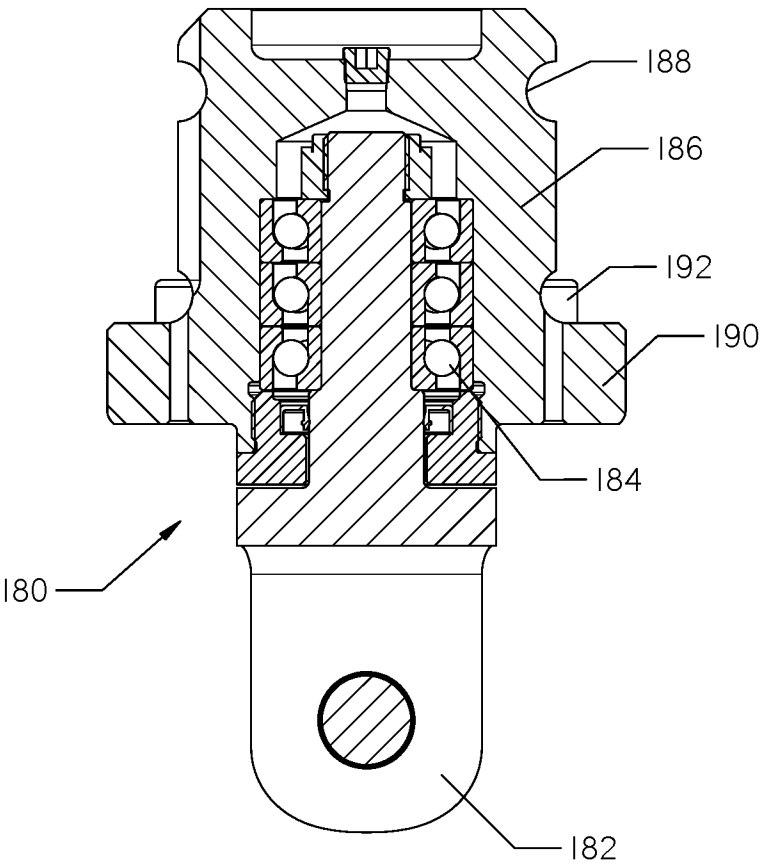
FIG. 9B is a front cross-sectional view of the pipe puller of FIG. 9A, taken along line 9B-9B.
Figure 9A:
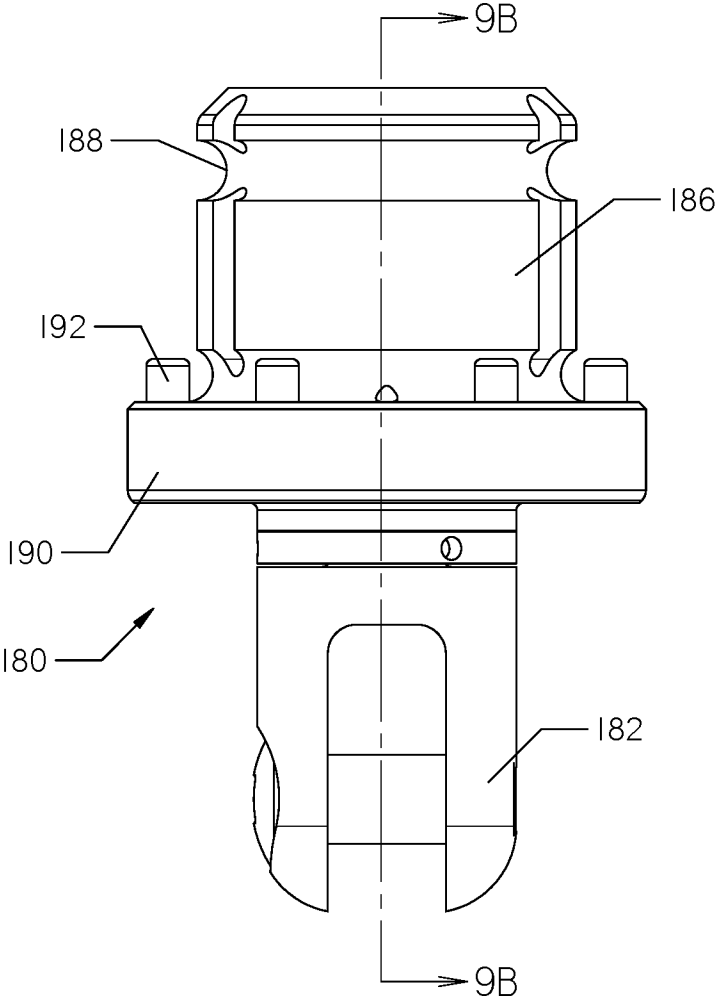
FIG. 9A is a front elevation view of a pipe puller with a stub end that includes features similar to the coupler of FIGS. 8A-8E.

With reference now to FIGS. 9A-9B, a pipe puller 180 is shown for connection to the receiving coupler 150 (FIG. 8A). The pipe puller 180 comprises a shackle 182, a bearing assembly 184 and a stub end 186. The shackle 182 facilitates connection to a product pipe (not shown) to be pulled back through the borehole by retraction of drill string 14 (FIG. 1). The bearing assembly 184 comprises a plurality of bearings, and allows the stub end 186 to rotate independently of the shackle 182.

The stub end 186 is configured for insertion into the cavity 39 of drill head 16. The stub end 186 has a circumferential groove 188 disposed about its exterior for connection with bolts 158 that are inserted through the holes 154 formed in the outer wall 34 of the receiving coupler 150.

The pipe puller 180 has a flange 190 disposed intermediate the shackle 182 and the stub end 186. The flange 190 supports a plurality of radially-disposed dowel rods 192. The dowel rods 192 correspond to the recesses 174 located in the outer wall 156 of the receiving coupler 150. The dowels rotationally lock the pipe puller 180 to the receiving coupler 150.

Figure 9C:
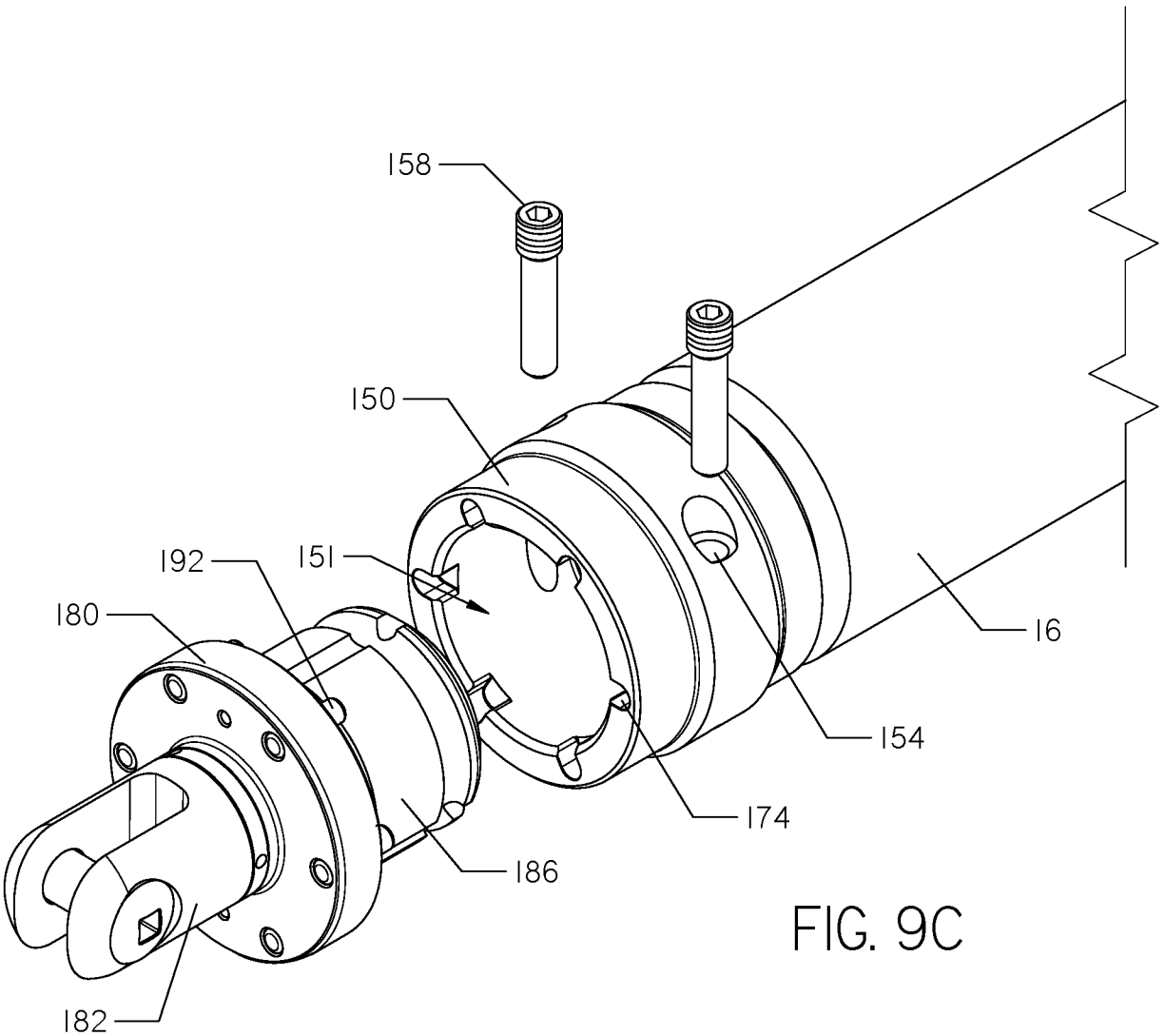
FIG. 9C is an exploded perspective view of the pipe puller of FIGS. 9A-9B. Also shown is a portion of the drill head and its receiving coupler, prior to assembly with the pipe puller.

As shown in FIG. 9B, while the dowel rods 192 prevent relative rotation between the stub end 186 and the receiving coupler 150 (FIG. 9C), the bearing assembly 184 allows the shackle 182 to freely rotate.

Figure 11C:
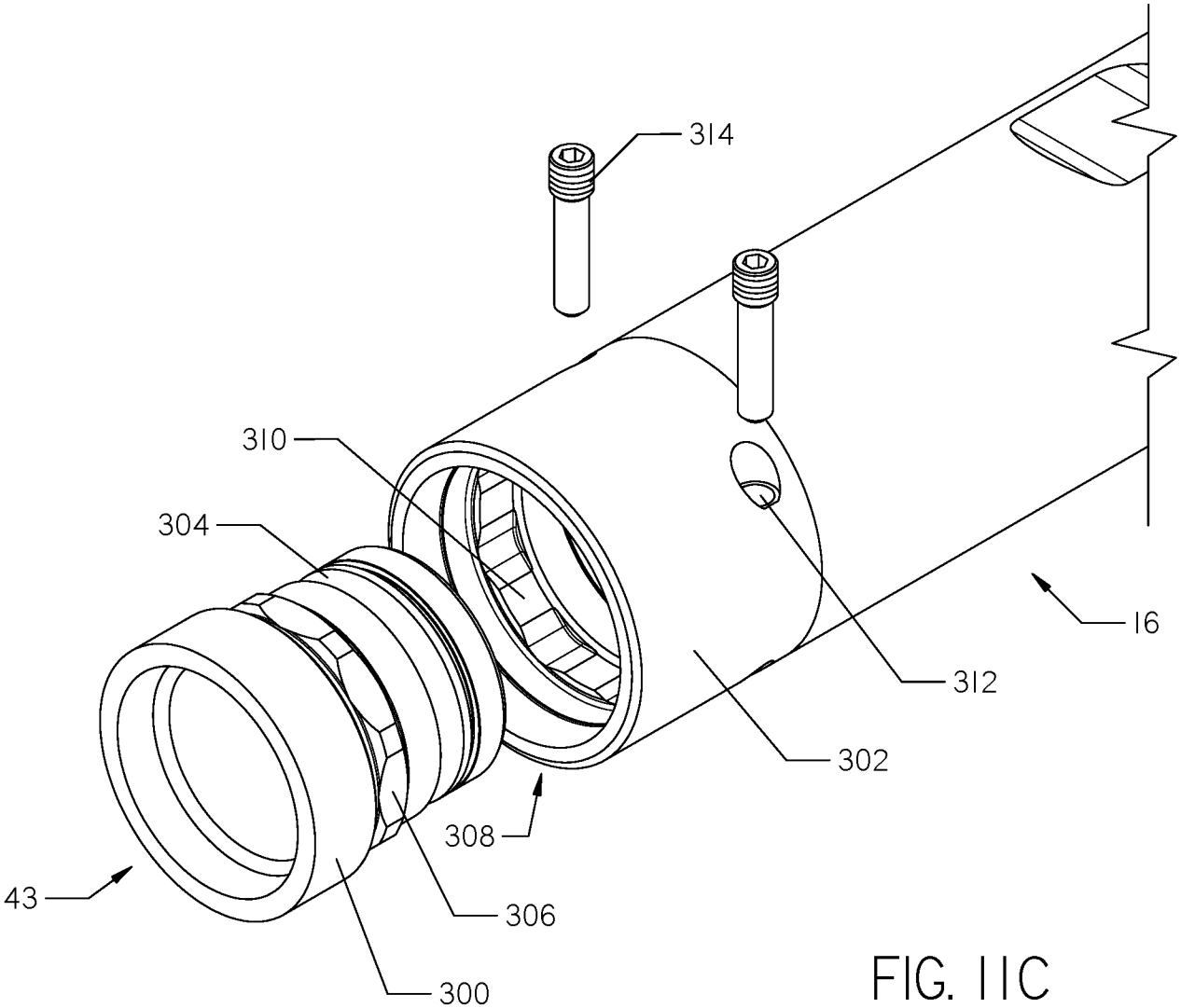
FIG. 11C is an exploded perspective view of the alternative coupler of FIG. 11A-11B, with a cavity of a receiving coupler shown.

With reference to FIGS. 11A-11C, another embodiment of a coupler 300 and receiving coupler 302 is shown for use with the drill head 16. The coupler 300 has an external surface characterized by a circumferential groove 304 and a plurality of flats 306. The receiving coupler 302 has an internal cavity 308 into which the coupler 300 may be slidingly received.

Flats 310 formed in the cavity 308 of the receiving coupler 302 correspond to the flats 306 on the coupler 300. The respective flats 306, 310 cooperate to bring the coupler 300 and receiving coupler 302 into torque-transmitting relationship.

The receiving coupler 302 has one or more through-holes 312 formed in its exterior surface. The through-holes axially correspond to the position of the circumferential groove 304 of the coupler 300. Bolts 314 are received into through holes 312 such that they engage the depth of the groove 304 at a tangent thereto. As shown, the receiving coupler 302 is threaded into the bearing assembly 22, rather than welded as shown in FIG. 8B.

It should be understood that a drill bit 18 may be threaded into the cavity 43 of the coupler 300, as with previous embodiments. Threads are removed from FIGS. 11B-11C for clarity. As with the previous embodiments, the flats 306, 310 of this embodiment may be adapted for use with other tools, such as pipe pullers, backreamers, and the like.

Figure 10A:
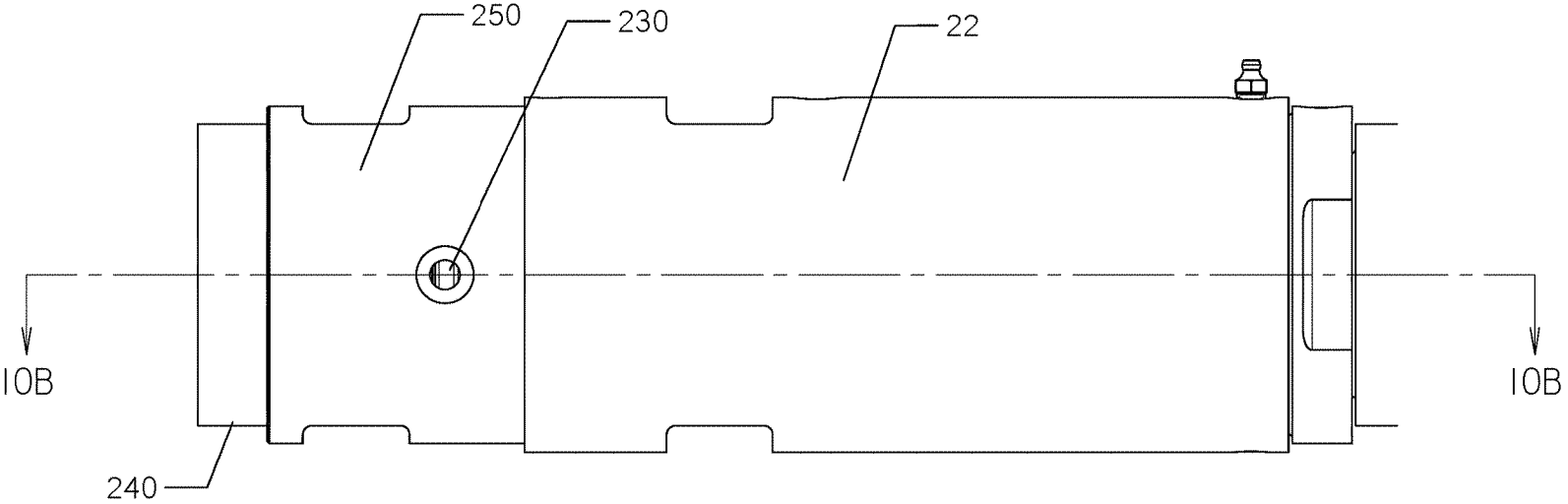
FIG. 10A is a front elevation view of an alternative drill head. The drill head is joined to another embodiment of a coupler.
Figure 10B:
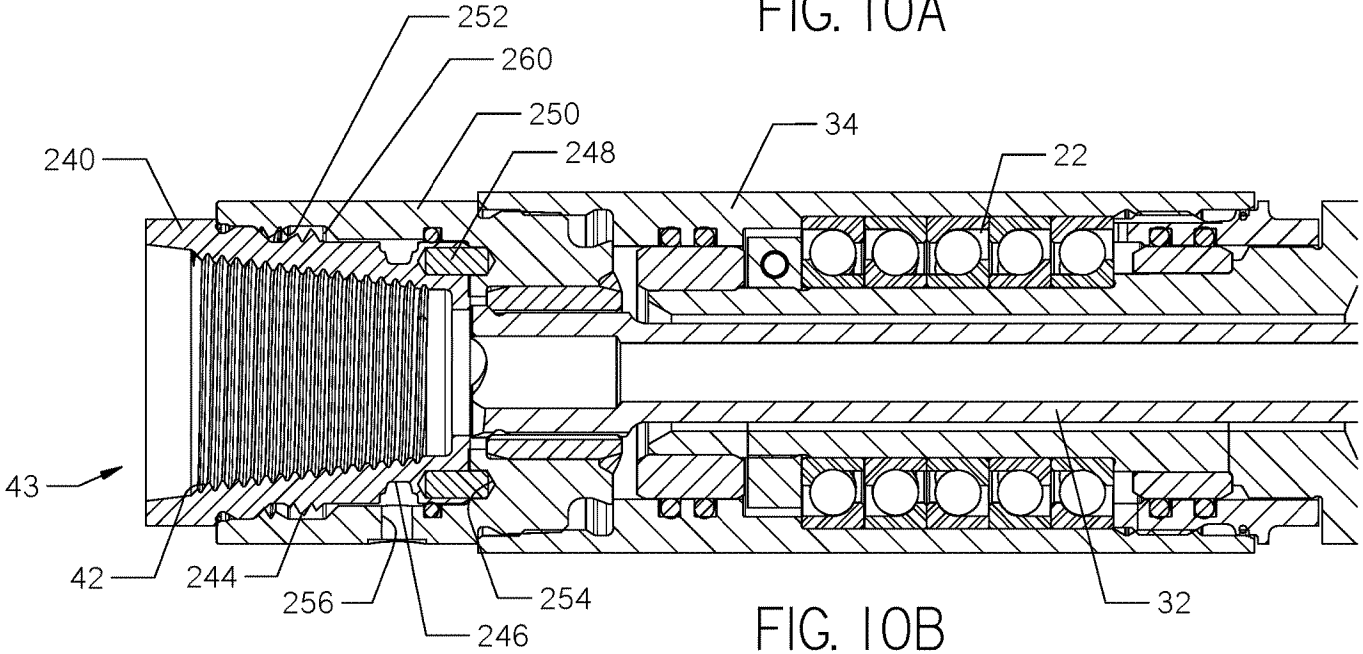
FIG. 10B is a front cross-sectional view of the drill head of FIG. 10A taken along line 10B-10B. The coupler is fully threaded into the cavity of the receiving coupler.
Figure 10C:
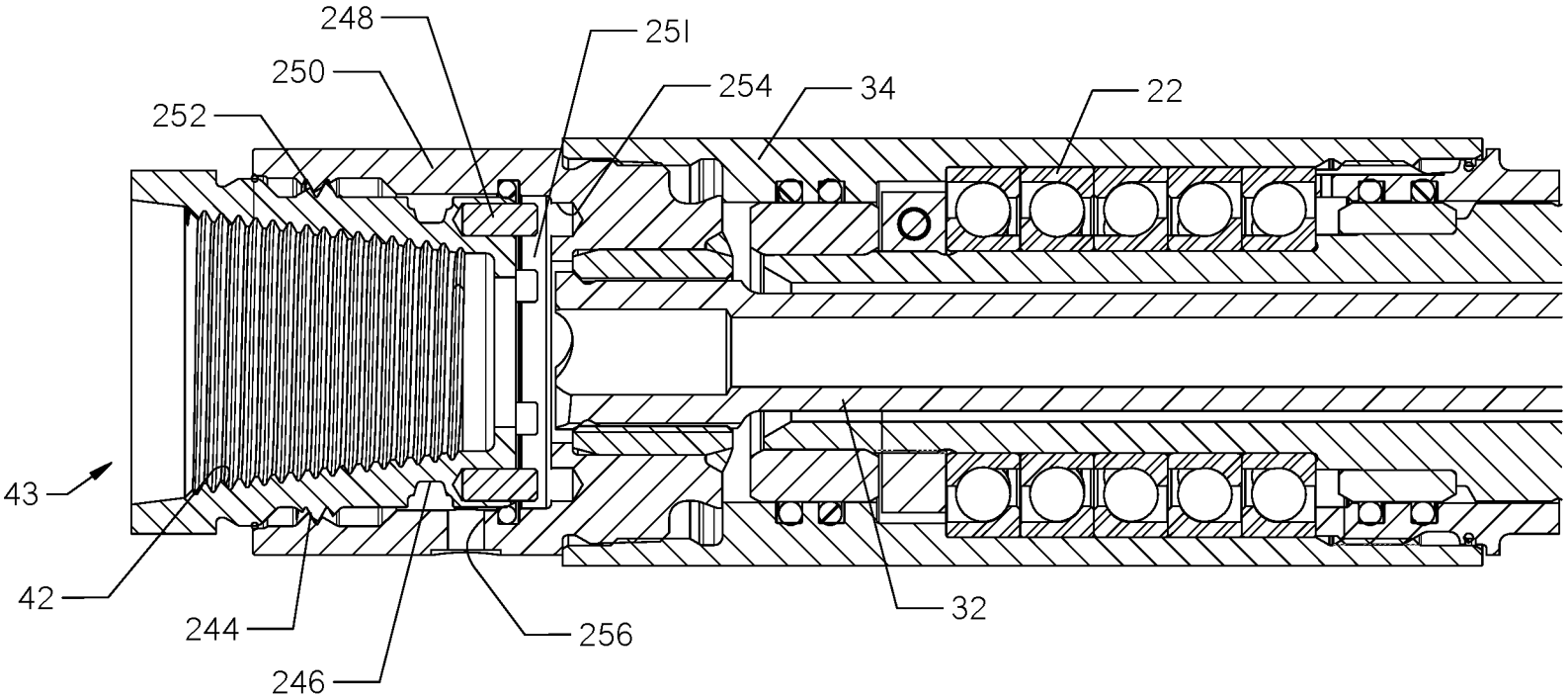
FIG. 10C is another front cross-sectional view, similar to FIG. 10B, showing the coupler partially removed from the cavity of the receiving coupler.

With reference now to FIGS. 10A-10C, another alternative coupler 240 is shown. The coupler 240 is received in a receiving coupler 250 which is attached to the drill head 16 at its cavity 39. As shown, the receiving coupler 250 has internal and external splines such that rotation provided by the shaft 32 is transmitted to the outer wall 34 of the bearing assembly 22. Alternatively, the receiving coupler 250 may be made integral with the drill head 16.

The coupler 240 has a first opening 43 with an internally threaded section 42. As with couplers 40, 140, this threaded section 42 is configured for connection to a male threaded end on a drill bit 18. The coupler 240 further comprises an external threaded section 244 disposed about its outer wall, and a circumferential groove 246. A plurality of dowel rods 248 are disposed at an end of the coupler 240.

The receiving coupler 250 has an internal cavity 251 with an open end. The coupler 240 may be received in the cavity 251, as with previously disclosed couplers 40, 140. The internal cavity 251 comprises a threaded section 252. The threaded sections 244, 252 provide a clearance limitation as the coupler 240 is placed into the cavity 251. During insertion, the coupler 240 must be rotated relative to the receiving coupler 250 to fully enter the cavity 251. FIG. 10C shows the coupler 240 being threaded into the cavity 251.

Once the engagement between threaded sections 244, 252 is complete, the coupler 240 may be advanced axially into the cavity 251 until dowel rods 248 engage with corresponding recesses 254.

The receiving coupler 250 has one or more openings 256 in its wall. One or more pins or bolts 230 (FIG. 10A) may be placed through the openings 256 into the circumferential groove 246 of the coupler 240 to prevent relative axial movement between the coupler 240 and receiving coupler 250. When fully inserted, the external threaded section 244 of the coupler 240 is situated in a recess 260, as shown in FIG. 10B.

The threaded sections 252, 244 preferably are oriented in an opposite direction from the direction of rotation of the drill string 14 and drill bit 18. As a result, the threaded sections 252, 244 cooperate to form a shoulder, preventing the coupler 244 from leaving the cavity 251 during drilling operations. However, upon completion of a drilling operation, an operator may manually remove the coupler 240 by removing bolt 230 from the groove 246 and openings 256. The coupler 240 may then be manually pulled out of the cavity 251 by properly rotating the coupler through the engagement of threaded sections 244, 252.

As with previous embodiments of the invention, a pipe puller having similar exterior qualities to coupler 240 may be provided to pull a pipe through the completed borehole. Likewise, the coupler 240 may be formed as an integral part of a drill bit 18.

While pipe pullers are one apparatus that can be attached to a drill string upon completion of a borehole, other components may be used. For example, a backreamer may be used to enlarge a borehole using pullback force from the drilling machine 12. Therefore, a backreamer may be threaded to a coupler 40, 140, 240 or may be provided with a compatible stub end for connection to the drill string. Other items which may utilize the connection system disclosed herein include cutters, stabilizers, jetting assemblies, locators, hammers, swivels or any appropriate downhole accessory. In the appended claims, drill bits, pipe pullers, backreamers and the other accessories listed may be referred to collectively as "downhole tools."

Furthermore, the shape of the dowel rods 192, 248 for torque transfer could be easily replaced with bolts, square keys, slotted keys, or any other torque conveying shape. Examples of torque conveying shapes include a hexagon, square or other engagement in place of dowels. Additionally, the dowel rods 192, 248 and corresponding recesses 174, 254 can be located on the opposite structure. For example, the dowel rods may be placed on the receiving couplers 150, 250 and the recesses on the couplers 140, 250.

Bolts 50, 230 may be set screws, dog-point screws, may slide or thread into couplers 40, 240, or may be any suitable fastening system that allows the position of the coupler to be set within the cavity. Likewise, bolts 158 may be roll pins, straight pins, splined fasteners, screws, etc. It should be understood that the specific type of fastener may be interchanged without departing from the spirit of the invention.

Changes may be made in the construction, operation and arrangement of the various parts, elements, steps and procedures described herein without departing from the spirit and scope of the invention as described in the following claims. Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise.

Phrases in the claims such as "configured to" are not intended to invoke the provisions of 35 U.S.C. § 112(f). When § 112 (f) is invoked herein, it will be due to the explicit use of the words "means for" or "step for".

The invention claimed is:

1. A method, comprising:

attaching a threaded drill bit to a threaded coupler;

attaching the coupler to a drillhead having an elongate, hollow body, whereby attaching the coupler comprises the steps of:

placing the coupler within an open end of the elongate, hollow body;

placing at least one fastener into a through-hole in the drillhead such that it is received in an externally-disposed depression disposed in the coupler;

thereafter, rotating and advancing the drill bit through an underground environment to an exit point.

2. The method of claim 1 further comprising:

after advancing the drill bit to the exit point, removing the fastener from the through-hole and the externally-disposed depression; and thereafter, removing the coupler from the hollow body of the drillhead.

3. The method of claim 2 further comprising:

after removing the coupler from the hollow body of the drillhead, inserting a pipe puller into the elongate hollow body, the pipe puller having an externally-disposed depression formed thereon; and thereafter, placing at least one fastener into the through-hole in the drill head such that it is received in the externally-disposed depression of the pipe puller.

4. The method of claim 3 further comprising:

attaching a product pipe to the pipe puller; and thereafter, pulling the product pipe through the underground environment.

5. The method of claim 1 in which the externally-disposed depression is a circumferential groove.

6. The method of claim 5 in which the fastener comprises a bolt disposed at a tangent to the circumferential groove.

7. The method of claim 1 further comprising:

registering the coupler to the elongate hollow body such that no relative rotation is allowed between the coupler and the elongate hollow body.

8. The method of claim 7 wherein the step of registering the coupler to the elongate hollow body comprises:

placing dowel pins placed in corresponding radially-arranged holes formed in the coupler; and placing the dowel pins into corresponding radially-arranged holes in the drill head.

9. The method of claim 7 wherein the coupler and the drill head are defined by complementary sections having torque-transmitting geometries, wherein the step of registering the coupler to the elongate hollow body comprises:

orienting the complementary section of the coupler and the complementary section of the elongate hollow body such that they are in torque-transmitting relationship when the coupler is received within the elongate hollow body.

10. The method of claim 1 wherein the drillhead is disposed at a distal end of a drill string.

11. A method, comprising:

advancing and rotating a drill string to advance a drill bit through an underground environment to an exit point, wherein the drill string and drill bit are connected by a coupler having uphole and downhole sections;

at the exit point, removing a fastener from a through-hole in the uphole section and an external depression in the downhole section; and separating the uphole and downhole sections of the coupler at the exit point.

12. The method of claim 11 further comprising:

placing a stub end of a pipe puller into the uphole section of the coupler;

disposing the fastener through the through-hole of the uphole section of the coupler such that it interacts with an external depression on the stub end.

13. The method of claim 12 further comprising:

after disposing the fastener through the through-hole of the uphole section of the coupler, attaching a product pipe to the pipe puller; and thereafter, pulling the product pipe through the underground environment with the drill string.

14. The method of claim 11 wherein the external depression is a circumferential groove and the fastener is configured to orient at a tangent to the circumferential groove when disposed in the through-hole.

15. The method of claim 11 further comprising:

prior to advancing and rotating the drill string, placing the uphole section and downhole section in torque-transmitting relationship.

16. The method of claim 15 in which the step of placing the uphole section and downhole section in torque-transmitting relationship comprises:

aligning a plurality of flat sections disposed on an external surface of the downhole section with a plurality of flat sections disposed on an internal surface of the uphole section; and placing the downhole section within the uphole section such that the plurality of flat sections are in at least partial face-to-face orientation.

17. The method of claim 15 in which the step of placing the uphole section and downhole section in torque-transmitting relationship comprises:

placing a plurality of dowel rods into longitudinally-extending, corresponding holes in the uphole section and the downhole section.

18. The method of claim 11 further comprising:

threading the drill bit to the downhole section of the coupler prior to advancing and rotating the drill string.

19. The method of claim 11 in which the drill bit and the downhole section of the coupler are unitary.

20. A method of detaching a drill bit from a drill string, comprising:

at an exit side of a borehole, removing a fastener from a throughhole formed in a drill head defining a cavity; and thereafter, sliding a component out of the cavity;

in which:

the through-hole is formed in the drill head; and an arcuate groove is formed on an exterior surface of the component and configured to receive the fastener when the component is within the cavity.

21. The method of claim 20 in which the component comprises a hollow body having a threaded inner surface, and further comprising:

unthreading the drill bit from the threaded inner surface of the component.

22. The method of claim 20 in which the component comprises a drill bit.

* * * * *